US008782904B2

(12) United States Patent
Wain

(10) Patent No.: US 8,782,904 B2
(45) Date of Patent: Jul. 22, 2014

(54) APPLICATOR FOR LIQUID DISPENSING HAIR REMOVAL DEVICE

(75) Inventor: Kevin James Wain, Reading (GB)

(73) Assignee: The Gillette Company, Boston, MA (US)

( * ) Notice: Subject to any disclaimer, the term of this patent is extended or adjusted under 35 U.S.C. 154(b) by 800 days.

(21) Appl. No.: 13/006,963

(22) Filed: Jan. 14, 2011

(65) Prior Publication Data

US 2012/0102748 A1 May 3, 2012

(30) Foreign Application Priority Data

Oct. 28, 2010 (CN) ..... 2010 1 0524331

(51) Int. Cl.
*B26B 21/44* (2006.01)

(52) U.S. Cl.
USPC ..... 30/41; 30/50

(58) Field of Classification Search
CPC ..... B26B 21/44
USPC ..... 30/34.05, 34.2, 41, 50
See application file for complete search history.

(56) References Cited

U.S. PATENT DOCUMENTS

| | | | | |
|---|---|---|---|---|
| 2,837,820 | A * | 6/1958 | Ostrowski | 30/51 |
| 3,032,803 | A | 5/1962 | Walshauser | |
| 3,252,217 | A | 5/1966 | Werft | |
| 3,417,468 | A | 12/1968 | Miyauchi | |
| 3,749,290 | A | 7/1973 | Micallef | |
| 3,822,720 | A | 7/1974 | Souza | |
| 4,129,942 | A | 12/1978 | Denizman | |
| 4,215,689 | A | 8/1980 | Akiyama et al. | |
| 4,809,432 | A | 3/1989 | Schauble | |
| 5,014,427 | A | 5/1991 | Byrne | |
| 5,022,154 | A | 6/1991 | Johnson | |
| 5,072,512 | A | 12/1991 | Noujain | |
| 5,092,041 | A | 3/1992 | Podolsky | |
| 5,103,560 | A | 4/1992 | Podolsky | |
| 5,134,775 | A | 8/1992 | Althaus et al. | |
| 5,168,628 | A | 12/1992 | Mock et al. | |
| 5,283,952 | A | 2/1994 | Mock et al. | |
| 5,316,452 | A | 5/1994 | Bogen et al. | |

(Continued)

FOREIGN PATENT DOCUMENTS

| | | |
|---|---|---|
| DE | 434493 | 9/1926 |
| DE | 3305898 A1 | 8/1984 |

(Continued)

OTHER PUBLICATIONS

PCT International Search Report with Written Opinion in corresponding Int'l appln. PCT/US2011/058205 dated Jan. 12, 2012.

(Continued)

*Primary Examiner* — Hwei C Payer
(74) *Attorney, Agent, or Firm* — Jay A. Krebs

(57) ABSTRACT

A liquid dispensing hair removal device having a handle with a cartridge mounted to the handle. The cartridge has a guard, a cap, and at least one blade behind the guard and in front of the cap. A dispensing unit is within the handle. The dispensing unit has a reservoir, a pump in liquid communication with the reservoir, and an applicator in liquid communication with the pump. The applicator has a guard with a plurality of ribs and an outlet port in front of the ribs.

7 Claims, 18 Drawing Sheets

(56) References Cited

U.S. PATENT DOCUMENTS

| | | | | |
|---|---|---|---|---|
| 5,337,478 | A | 8/1994 | Cohen et al. | |
| 5,402,573 | A | 4/1995 | Laniado | |
| 5,402,697 | A | 4/1995 | Brooks | |
| 5,638,601 | A | 6/1997 | Mol et al. | |
| 5,645,114 | A | 7/1997 | Bogen et al. | |
| 5,689,883 | A * | 11/1997 | Ortiz et al. | 30/34.2 |
| 5,725,483 | A | 3/1998 | Podolsky | |
| 5,855,066 | A | 1/1999 | Manger | |
| 5,983,500 | A | 11/1999 | da Silva | |
| 5,993,180 | A | 11/1999 | Westerhof et al. | |
| 6,126,669 | A | 10/2000 | Rijken et al. | |
| 6,131,288 | A | 10/2000 | Westerhof et al. | |
| D437,661 | S | 2/2001 | Pinchuk | |
| 6,308,413 | B1 | 10/2001 | Westerhof et al. | |
| 6,312,436 | B1 | 11/2001 | Rijken et al. | |
| 6,493,940 | B2 | 12/2002 | Westerhof et al. | |
| 6,554,589 | B2 | 4/2003 | Grapes | |
| 6,665,937 | B2 | 12/2003 | Fürst et al. | |
| 6,754,958 | B2 | 6/2004 | Haws et al. | |
| RE38,634 | E | 10/2004 | Westerhof et al. | |
| 6,851,190 | B2 | 2/2005 | Guimont et al. | |
| 6,871,679 | B2 | 3/2005 | Last | |
| 6,886,254 | B1 | 5/2005 | Pennella | |
| 6,910,274 | B1 | 6/2005 | Pennella et al. | |
| 6,913,606 | B2 | 7/2005 | Saitou et al. | |
| 6,925,716 | B2 | 8/2005 | Bressler et al. | |
| 6,964,097 | B2 | 11/2005 | Franzini et al. | |
| 6,986,207 | B2 | 1/2006 | Selek | |
| 7,007,389 | B1 | 3/2006 | Arif | |
| 7,021,195 | B2 | 4/2006 | Proust | |
| 7,043,841 | B2 | 5/2006 | Franzini et al. | |
| 7,051,439 | B2 | 5/2006 | Tomassetti | |
| 7,107,684 | B2 | 9/2006 | Steele et al. | |
| 7,121,754 | B2 | 10/2006 | Bressler et al. | |
| 7,137,203 | B2 | 11/2006 | Bressler et al. | |
| 7,155,828 | B2 | 1/2007 | Guimont et al. | |
| 7,234,239 | B2 | 6/2007 | Saito et al. | |
| D567,442 | S | 4/2008 | McMullan | |
| 7,402,165 | B2 | 7/2008 | Saitou et al. | |
| 7,651,010 | B2 | 1/2010 | Orzech et al. | |
| 7,686,675 | B2 | 3/2010 | Steele | |
| 7,752,757 | B2 | 7/2010 | Salvatore, Jr. | |
| 7,788,809 | B2 | 9/2010 | Tomassetti | |
| 7,814,661 | B2 | 10/2010 | Tomassetti | |
| 8,209,867 | B2 | 7/2012 | Clarke | |
| 8,220,156 | B2 * | 7/2012 | Forsdike et al. | 30/41 |
| 8,510,957 | B2 * | 8/2013 | Wain et al. | 30/41 |
| 2003/0196328 | A1 | 10/2003 | Andino et al. | |
| 2004/0177510 | A1 | 9/2004 | Pennella | |
| 2004/0177519 | A1 | 9/2004 | Tomassetti et al. | |
| 2004/0191128 | A1 | 9/2004 | Bogen et al. | |
| 2004/0255465 | A1 | 12/2004 | Pennella et al. | |
| 2005/0123342 | A1 | 6/2005 | Bressler et al. | |
| 2005/0260090 | A1 | 11/2005 | Stark et al. | |
| 2006/0117582 | A1 | 6/2006 | Al-Aula | |
| 2006/0150386 | A1 | 7/2006 | Wanli et al. | |
| 2006/0240380 | A1 | 10/2006 | Chenvainu et al. | |
| 2006/0272154 | A1 | 12/2006 | Brevard | |
| 2007/0214646 | A1 | 9/2007 | Bezdek | |
| 2008/0216322 | A1 | 9/2008 | Molema et al. | |
| 2008/0307660 | A1 | 12/2008 | Clarke | |
| 2009/0183371 | A1 | 7/2009 | Mileti et al. | |
| 2009/0211099 | A1 | 8/2009 | Louis | |
| 2009/0263176 | A1 | 10/2009 | Mileti et al. | |
| 2009/0318883 | A1 | 12/2009 | Sugahara et al. | |
| 2010/0040489 | A1 | 2/2010 | Rosenzweig et al. | |
| 2010/0107415 | A1 | 5/2010 | Kurzet | |
| 2010/0115774 | A1 | 5/2010 | De Klerk | |
| 2010/0119923 | A1 * | 5/2010 | Wu et al. | 429/97 |
| 2010/0236071 | A1 | 9/2010 | Szczepanowski et al. | |
| 2012/0102745 | A1 * | 5/2012 | Jessemey et al. | 30/41 |
| 2012/0102747 | A1 * | 5/2012 | Wain | 30/41 |
| 2012/0102748 | A1 * | 5/2012 | Wain | 30/41 |
| 2012/0102761 | A1 * | 5/2012 | Jessemey et al. | 30/346.58 |
| 2013/0145623 | A1 * | 6/2013 | Wain | 30/41 |
| 2013/0145626 | A1 * | 6/2013 | Xu et al. | 30/41 |

FOREIGN PATENT DOCUMENTS

| | | | |
|---|---|---|---|
| FR | 2551391 | * | 3/1985 |
| FR | 2551391 | A1 | 3/1985 |
| FR | 2683759 | A1 | 5/1993 |
| FR | 2 703 403 | | 10/1994 |
| GB | 1386461 | | 3/1975 |
| JP | 9-24982 | | 1/1997 |
| WO | WO 82/02372 | | 7/1982 |
| WO | WO 87/02422 | | 4/1987 |
| WO | WO 2006/122368 | A1 | 11/2006 |

OTHER PUBLICATIONS

U.S. Appl. No. 13/006,796, filed Jan. 14, 2011, Paul M. Jessemey et al.
U.S. Appl. No. 13/006,816, filed Jan. 14, 2011, Kevin J. Wain et al.
U.S. Appl. No. 13/006,835, filed Jan. 14, 2011, Edward N. Forsdike et al.
U.S. Appl. No. 13/006,862, filed Jan. 14, 2011, Paul M. Jessemey et al.
U.S. Appl. No. 13/006,888, filed Jan. 14, 2011, Paul M. Jessemey et al.
U.S. Appl. No. 13/006,903, filed Jan. 14, 2011, Paul M. Jessemey et al.
U.S. Appl. No. 13/006,918, filed Jan. 14, 2011, Paul M. Jessemey et al.
U.S. Appl. No. 13/006,939, filed Jan. 14, 2011, Kevin J. Wain.
U.S. Appl. No. 13/006,976, filed Jan. 14, 2011, Kevin J. Wain et al.

* cited by examiner

APPLICATOR FOR LIQUID DISPENSING HAIR REMOVAL DEVICE

FIELD OF THE INVENTION

The present invention relates to hair removal devices in general, and, more particularly, hair removal devices having mechanisms for providing one or more flowable shaving aid materials.

BACKGROUND OF THE INVENTION

Skin care can be of particular importance in improving or enhancing the appearance of men and women. Various products and methods can be used to care for skin. For example, exfoliant scrubs, cleansers, and lotions are sometimes used to maintain healthy-looking skin. Exfoliant scrubs can be used to remove dead skin cells from the surface of the skin, which can give the skin an improved tone. Soaps and other cleansers can be used to remove dirt and excess oil from the skin, which can help prevent clogging of pores. Consequently, acne and other types of skin blemishes can be prevented in some cases. Lotions and various other topical ointments can also be used to deliver nutrients and/or moisturizers to the skin in an effort to improve the appearance and/or the health of the skin. Other types of cosmetic products (e.g., creams and lotions) or drug actives are sometimes used in an attempt to eliminate wrinkling and other signs of aging.

It is generally known that the process of shaving the skin may provide certain skin benefits such as exfoliation and hydration. In general, shaving razors of the wet shave type include a cartridge or blade unit with at least one blade with a cutting edge which is moved across the surface of the skin being shaved by means of a handle to which the cartridge is attached; however, razor assemblies may also include electric foil type shavers. The cartridge may be mounted detachably on the handle to enable the cartridge to be replaced by a fresh cartridge when the blade sharpness has diminished to an unsatisfactory level, or it may be attached permanently to the handle with the intention that the entire razor be discarded when the blade or blades have become dulled (i.e., disposable razor). The connection of the cartridge to the handle provides a pivotal mounting of the cartridge with respect to the handle so that the cartridge angle adjusts to follow the contours of the surface being shaved. In such systems, the cartridge can be biased toward a rest position by the action of a spring-biased plunger (a cam follower) carried on the handle against a cam surface on the cartridge housing.

The shaving process typically includes the application of a shaving aid material (e.g., shaving cream) to the surface and the separate step of shaving the hair using a razor assembly. The shaving aid material oftentimes includes at least one suitable agent (e.g., a lubricating agent, a drag-reducing agent, a depilatory agent, etc.) that enhances the shaving process. Most consumers find this type of preparation to be rather inconvenient because of the need for multiple shaving products, e.g., a wet shaving razor and a skin preparation product, as well as the undesirable necessity for multiple application steps during the wet shaving process. Furthermore, this process can be messy and requires the consumer rinse their hands after applying the shave gel. This multi-step process also results in an overall extended shaving experience which most consumers do not prefer given typical morning hygiene routines. It may, however, be desirable sometimes to apply liquids of other kinds to the skin before, during, or after shaving. It has been found that especially in the case of males who shave facial hair, it is important to provide a shave preparation of some sort prior to shaving in order to adequately hydrate the coarser facial hairs to allow for an easier and closer shave.

In the past, there have been a number of wet shaving product configurations that include a system for conveying a shaving preparation during shaving, e.g. a lubricating liquid, from a reservoir incorporated in the razor structure in the form of a hollowed out razor handle or even an aerosol can that acts as a razor handle, to a dispensing location near the head of the razor. A number of more recent wet shaving razors have cartridges that are movably mounted, in particular pivotable, relative to the handle structures on which they are mounted either permanently, in the case of disposable safety razors intended to be discarded when the blade or blades have become dulled, or detachably to allow replacement of the blade unit on a reusable handle structure. Many of these types of razors that are capable of conveying a liquid to the skin surface are unfortunately plagued by a number of problems. For instance, the innerworkings of the razors are complicated and tend to be cost prohibitive from a large scale manufacturing standpoint. Additionally, there are safety and performance issues that are constantly experienced due to microbial growth within the reservoir due to the continued exposure of a portion of the remaining liquid to air. This exposure of the liquid to air may oftentimes result in clogging of the razor's innerworkings by the liquid resulting in a nonperforming shaving product.

The hair removal process is known to cause certain irritations and discomfort for skin. Accordingly, desirable skin benefits may include soothing and moisturization. Soothing and moisturization are not typically achieved by a shaving razor by itself, but by a lotion or cream that is applied to the skin after shaving and after the shave gel has been removed from the skin. Regardless of whether the hair removal process is via a wet or dry shave, there is an ongoing need to provide certain personal care compositions to accompany or facilitate the hair removal process. Typically, the personal care composition is sold as a separate package.

SUMMARY OF THE INVENTION

In one aspect, the invention features, in general, a liquid dispensing hair removal device having a handle with a cartridge mounted to the handle. The cartridge has a guard, a cap, and at least one blade behind the guard and in front of the cap. A dispensing unit is within the handle. The dispensing unit has a reservoir, a pump in liquid communication with the reservoir, and an applicator in liquid communication with the pump. The applicator has a guard with a plurality of ribs and an outlet port in front of the ribs.

The details of one or more embodiments of the invention are set forth in the accompanying drawings and the description below. Other features and advantages of the invention will be apparent from the description and drawings, and from the claims.

DETAILED DESCRIPTION OF THE INVENTION

Figure 1A:
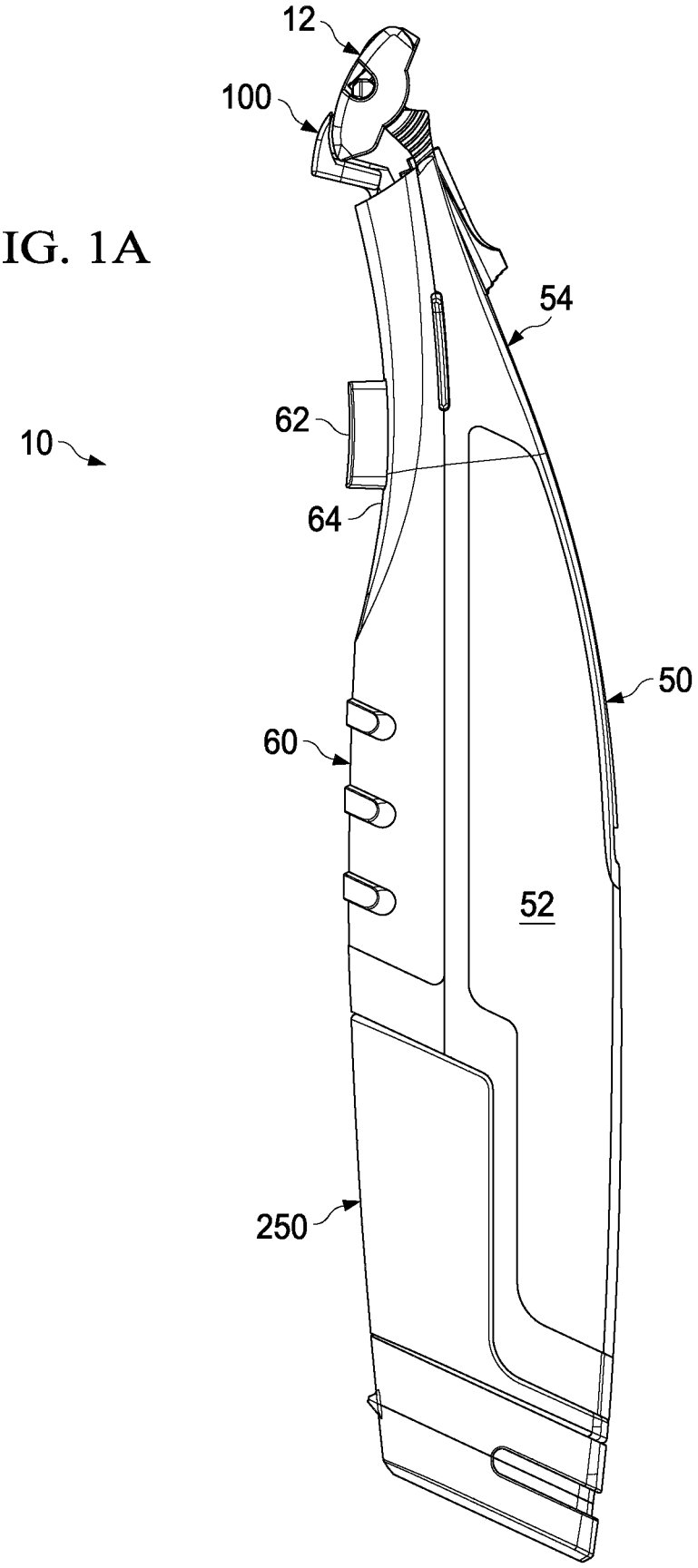
FIG. 1A is a side view of one possible embodiment of a hair removal device.

The present disclosure is not limited to wet shaving razors, or even razors in general. It is understood that certain aspects of the present disclosure may also be used for dry electric shaving razors that have one or more rotating or reciprocating blades or other personal care appliances (e.g., toothbrushes, depilatory applicators, epilators, or other beauty applicators). Furthermore, it is understood that certain aspects of the present disclosure may be used independently of applying a liquid (e.g., a cartridge and a dispensing unit 150 may be used independently).

The present disclosure is not limited to shaving cartridges in which the blades are rigidly mounted in a fixed position relative to a guard and/or a cap. If the blades are capable of movement then the geometric parameters stipulated herein are those which apply when the blades are in their normal rest positions. Each of the illustrated safety razor blade units are intended to be mounted on a razor handle. The blade unit may be permanently attached to the handle, e.g., in a disposable razor, or may be formed as a cartridge adapted to be mounted releasably to the handle. The blade unit may be pivotally mounted to the handle or may be fixedly attached to the handle.

One or more blades may be mounted to a housing. The term "mounted to" may be defined as any of the following disclosed herein. The cutting blade may be supported firmly by the housing to remain substantially fixed in the positions in which they are depicted (subject to any resilient deformation which the blades undergo under the forces applied against the blades during shaving). Alternatively, the blades may be supported for limited movement against spring restoring forces, e.g., in a downward direction as viewed in the drawings. The basic construction and assembly of the blade units may be conventional.

Figure 1B:
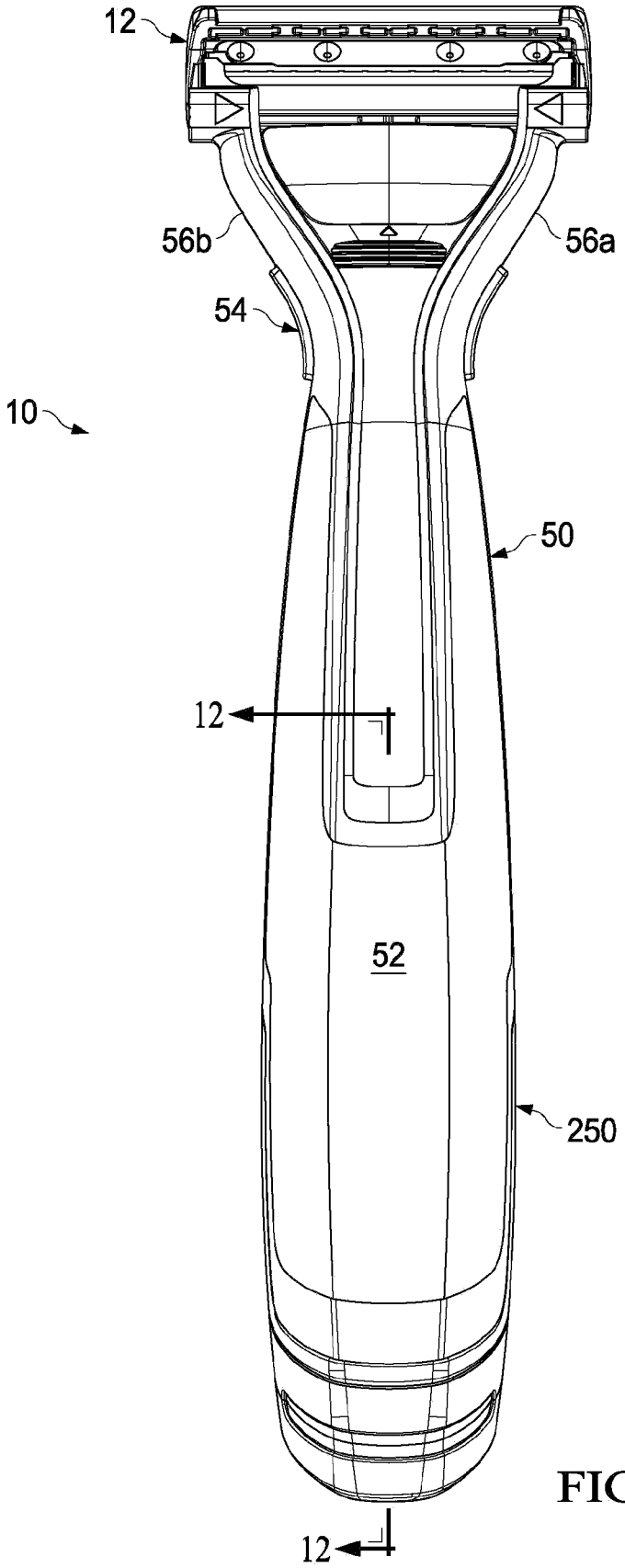
FIG. 1B is a top view of the hair removal device of FIG. 1A.

Referring to FIGS. 1A and 1B, one possible embodiment of the present disclosure is shown illustrating a side view and a top view (respectively) of a hair removal device 10 with a hair removal cartridge 12 mounted to a handle 50. The hair removal device 10 may include, but not limited to shaving razors, depilatory applicators, and epilators. In certain embodiments, the handle 50 may be molded from a semi-rigid material, such as high impact polystyrene. The handle 50 may be molded from other semi-rigid polymers having a Shore D hardness of about 60 to 140, including, but not limited to Noryl™ (a blend of polyphenylene oxide (PPO) and polystyrene developed by General Electric Plastics, now SABIC Innovative Plastics), acrylonitrile butadiene styrene (ABS), acetal, polypropylene, high impact polystyrene, or any combinations thereof. In certain embodiments, the handle 50 may comprise metal (e.g., the handle 50 may be die casted metal or have metal inserts to increase the weight of the handle 50).

As will be explained in greater detail below, the cartridge 12 may be pivotably (i.e., rotation of the cartridge 12 about an axis relative to the handle 50 and/or detachably engaged to the handle 50). It is understood that certain embodiments may include cartridges 12 that pivot in relation to the handle 50, but are also permanently secured to the handle 50 (i.e., disposable shaving razors). Disposable razors may have either a pivoting or non pivoting type cartridge 12. The handle 50 may have a body 52 and a neck 54. The body 52 of the handle 50 may provide an area for the user to comfortably grip the hair removal device 10. The neck 54 may have a generally "V" shape geometry with a pair of opposing arms 56*a* and 56*b* that extend from the body 52 and engage the cartridge 12. As will be explained in greater detail below, the hair removal device 10 may have a removable dispensing unit (not shown) at least partially disposed within the handle 50. The dispensing unit 150 may have an applicator 100 that supports the cartridge 12 and flexes as the cartridge 12 pivots relative to the handle 50. In certain embodiments, the cartridge 12 may be biased toward a rest position by the action of the applicator 100 (e.g., the applicator 100 applies a biasing force against the cartridge 12 during a shaving stroke). A cover 60 may be mounted to the handle 50 to secure the dispensing unit within the handle 50. The handle 50 and/or cover 60 may have an actuator 62 disposed on an outer surface 64 to facilitate the dispensing of a liquid from the dispensing unit. A removable personal care bottle 250 containing a second liquid may be mounted to one end of the handle 50. The hair removal device 10 may provide multiple skin benefits without the need of purchasing any additional creams, lotions, and/or cleansers. The hair removal device 10 may dispense a first liquid during shaving on or near the cartridge 12. The hair removal device 10 may also contain a second liquid that can be dispensed independently of the first liquid. The first and second liquids may be the same or different.

Figure 2A:
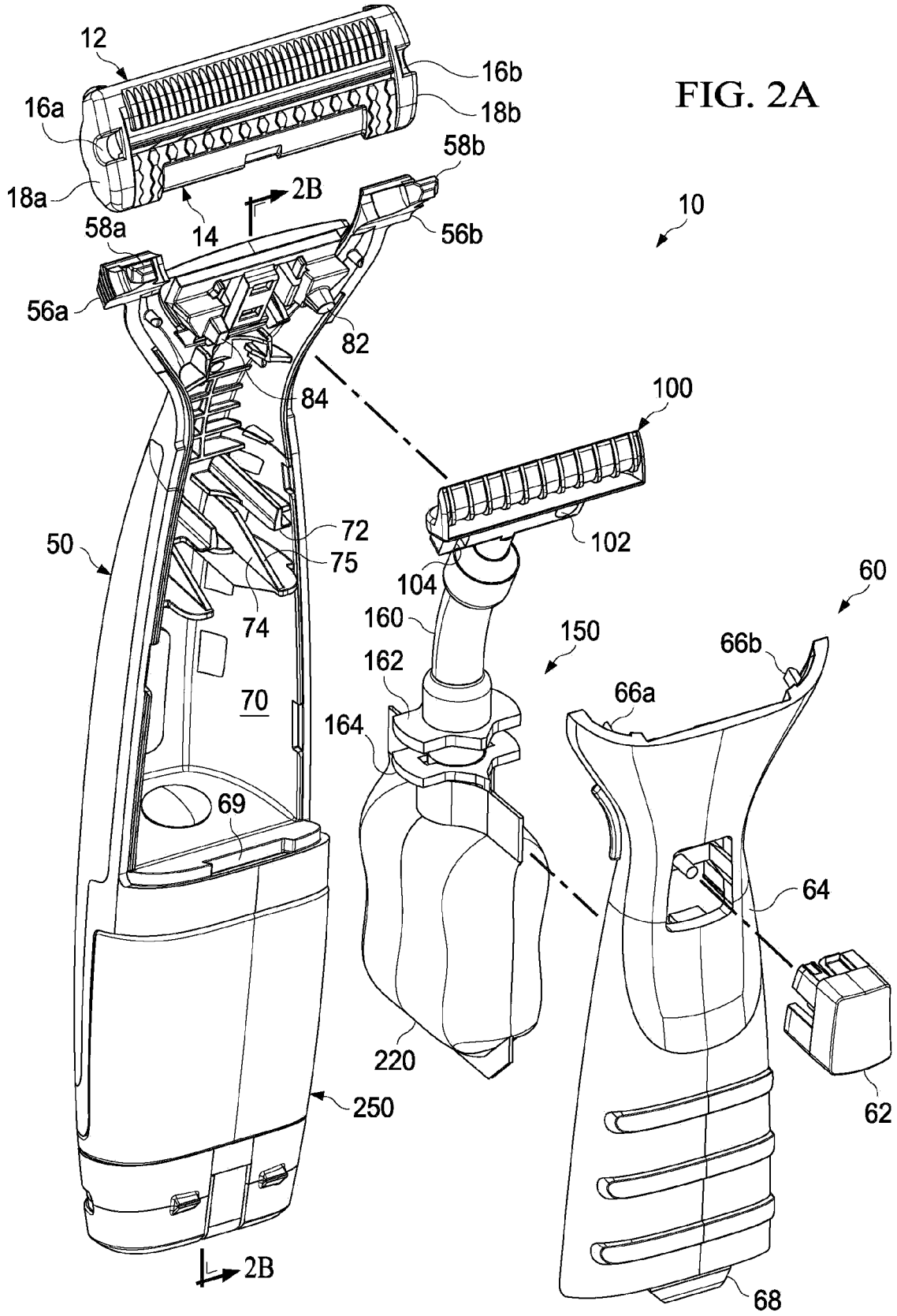
FIG. 2A is a perspective assembly view of the hair removal device of FIG. 1.
Figure 2B:
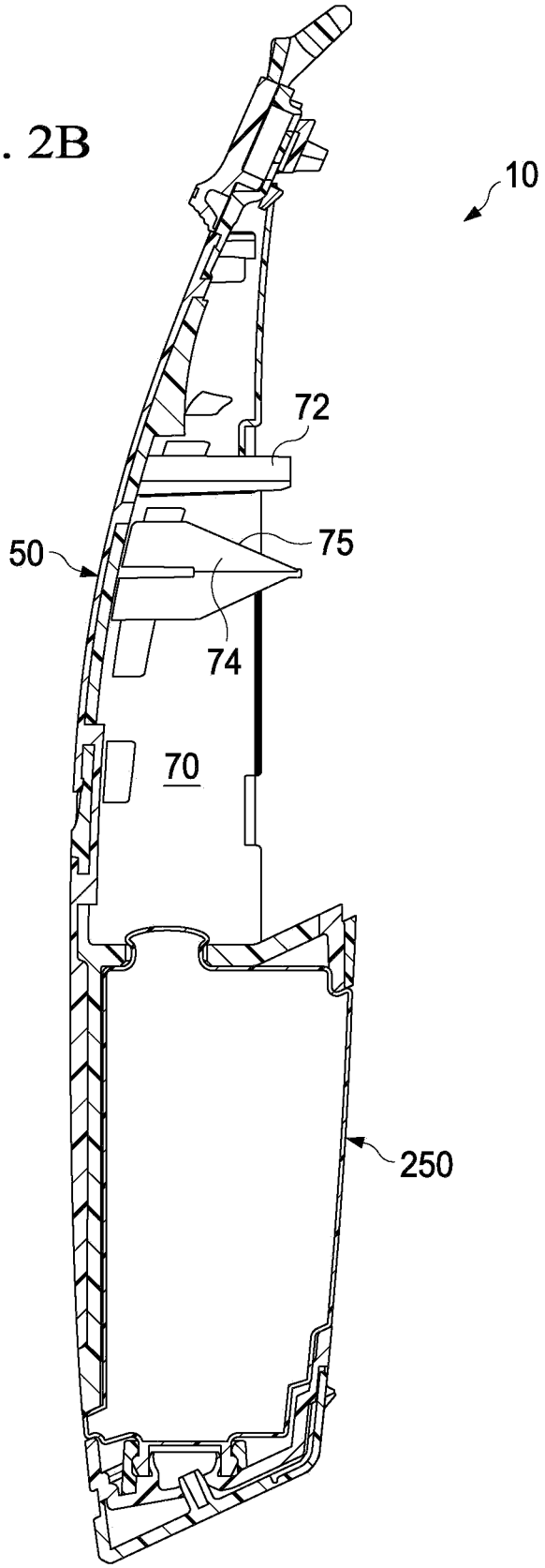
FIG. 2B is a cross section view of a portion of the hair removal device, taken generally along the line 2B-2B of FIG. 2A.

Referring to FIGS. 2A and 2B, a top assembly view of the hair removal device 10 of FIG. 1 is shown and a cross section view of the handle 50, taken generally along the line 2B-2B of FIG. 2A are illustrated. The hair removal device 10 may be an assembly that includes a plurality of consumables which may be purchased separately by the consumer. For example, in certain embodiments, the consumer may separately purchase the cartridge 12, the personal care bottle 250, and/or a dispensing unit 150. In certain embodiments, the reservoir 220 may also be purchased separately and attached to the pump 160 by the consumer. As will be explained in greater detail below, dispensing unit 150 may include the applicator 100, a pump 160 in liquid communication with the applicator 100, and a reservoir 220 in liquid communication with the pump 160. The reservoir 220 may contain one or more liquids that may be useful in the present hair removal device 10. For instance, shaving gels, shaving foams, shaving lotions, skin treatment compositions, conditioning aids, depilatories, etc. may be used to prepare the hair and skin's surface prior to and during shaving.

Air may be removed from the reservoir 220 with a vacuum and then the reservoir 220 may be filled and pressurized with a liquid to provide an airless system. The filled reservoir 220 may utilize space more effectively than a rigid bottle, but also provide enough rigidity so the consumer can easily load the reservoir 220 within the handle 50. In addition, loading the reservoir 220 into the handle 50 may compress the reservoir 220 so when the dispensing unit 150 is activated, the pump 160 is partially filled with the liquid to reduce the need for priming the pump 160.

In certain embodiments, the reservoir 220 may be flexible laminated sachet to provide barrier performance (e.g., resistance to water and oxygen loss). The reservoir 220 may comprise a foil barrier layer (e.g., aluminum) between a polyethylene inner layer and a polyethylene terephthalate (PET) outer layer. Alternatively, the inner and/or outer layer may be metalized (e.g., a polymeric film containing or coating with metal particles). For example, the reservoir 220 may comprise an inner layer of a metalized polyethylene film having a thickness of about 30 um, 40 um, or 50 um to about 70 um, 80 um, or 90 um. The inner layer may be laminated to an outer layer of PET film with a thickness of about 6 um, 7 um, or 8 um to about 10 um, 11 um, or 12 um. The inner layer and outer layer may be laminated together during an extrusion process or adhesive may be used to seal the two layers together. The reservoir 220 may be heat sealed to a semi-rigid reservoir connector 164. The PET outer layer may have a higher melt temperature than the polyethylene inner layer. Accordingly, the inner layer seals tightly to the reservoir connector 164 (e.g., providing a liquid impervious seal) and the outer layer may not melt to maintain the integrity of the reservoir 220.

Over time, water and other chemicals have a tendency to permeate through films which can have detrimental consequences on the chemistry and performance of the liquid formulation contained within the reservoir 220. The flexibility of the reservoir 220 allows the reservoir 220 to be deformable for maximum space utilization within handle 50. The barrier properties may be achieved by increasing the thickness of the reservoir 220 material, thus making the reservoir less flexible. A metalized polymer film, such as polyethylene, may provide superior barrier properties to prevent the unwanted passage of water and oxygen into or out of the reservoir 220 without sacrificing flexibility. In certain embodiments, the overall wall thickness of the reservoir 220 may be about 36 um, 46 um, or 56 um to about 70 um, 80 um, or 101 um.

In certain embodiments, the pump 160 and the applicator 100 may not be in liquid communication with the reservoir 220 until the dispensing unit 150 is activated (e.g., assembled within the handle 50 and/or the cover 60 is secured to the handle 50). The dispensing unit 150 may have a first connector (e.g., pump connector 162) and a second connector (e.g., the reservoir connector 164) that are in liquid communication with the pump 160. The reservoir 220 (e.g., the polyethylene inner layer) may be heat sealed around the reservoir connector 164. As will be explained in greater detail below, the pump connector 162 and the reservoir connector 164 may be moved from a first position (e.g., sealed position) to a second position (e.g., activated position). In the first position, the pump 160 and the applicator 100 may not be in liquid communication with the reservoir 220. In the second position, the pump 160 and the applicator 100 may be in liquid communication with the reservoir 220, thus allowing for the liquid contained within the reservoir 220 to be dispensed.

The handle 50 may define a first cavity 70 dimensioned to receive at least a portion of a dispensing unit 150. For example, the reservoir 220 may be completely enclosed within the handle 50 and/or cover 60, but the applicator 100 may not be completely enclosed by the handle 50 and/or cover 60. The applicator 100 may be removably engaged within a recess 14 of the cartridge 12. The applicator 100 may have one or more alignment members 102 and 104 to facilitate the correct positioning of the dispensing unit 150 and/or applicator 100 within the handle 50. If the dispensing unit 150 is not properly orientated within the handle 50, the dispensing unit 150 may become damaged or may not release the liquid from the reservoir 220 properly. The alignment members 102 and 104 may be spaced apart recesses and/or projections that are a different size, shape, orientation, or any combination thereof. The handle 50 may have one or more corresponding alignment members 82 and 84 that are dimensioned to receive the one or more alignment members 102 and 104 of the applicator 100. The alignment members 82 and 84 of the handle 50 and the alignment members 102 and 104 of the applicator 100 may ensure the applicator 100 is properly located within the recess 14 of the cartridge 12.

The handle 50 may have a pair of spaced apart walls 72 and 74 within the first cavity 70. At least one pair of the spaced apart walls 72 and 74 may have a tapered surface 75 (as shown in FIG. 2B) sloped toward the opposing spaced apart wall 72 and 74 to facilitate the actuation of the pump connector 162 and the reservoir connector 164 and thereby providing liquid communication from the reservoir 220 to the applicator 100. In certain embodiments, the wall 72 may be vertical and the tapered surface 75 may be positioned on the wall 74 that is in contact with the reservoir connector 164 to prevent the pump 160 and/or the applicator 100 from moving or stretching as the dispensing unit 150 is activated (i.e., moves from the first position to the second position). The tapered surface 75 of the wall 74 may have a slope of about 20 degrees, 22 degrees, or 24 degrees to about 26 degrees, 28 degrees, or 30 degrees relative to the opposing wall 72. The tapered surface 75 may facilitate the pump connector 162 and/or the reservoir connector 164 to move a horizontal distance of about 2 mm, 3 mm, or 4 mm to about 5 mm, 6 mm, or 7 mm. As the cover 60 is mounted to the handle 50, the cover 60 may force the reservoir connector 164 to slide along tapered surface 75 moving the pump connector 162 and the reservoir connector toward each other to activate the dispensing unit 150. The pair of spaced apart walls 72 and 74 may be continuous or segmented to accommodate the positioning of the dispensing unit 150 within the cavity 70 of the handle 50. Once in place, the spaced apart walls 72 and 74 may provide a contact pressure on the reservoir connector 164 and the pump connector 162, thus preventing disengagement during use.

Figure 3:
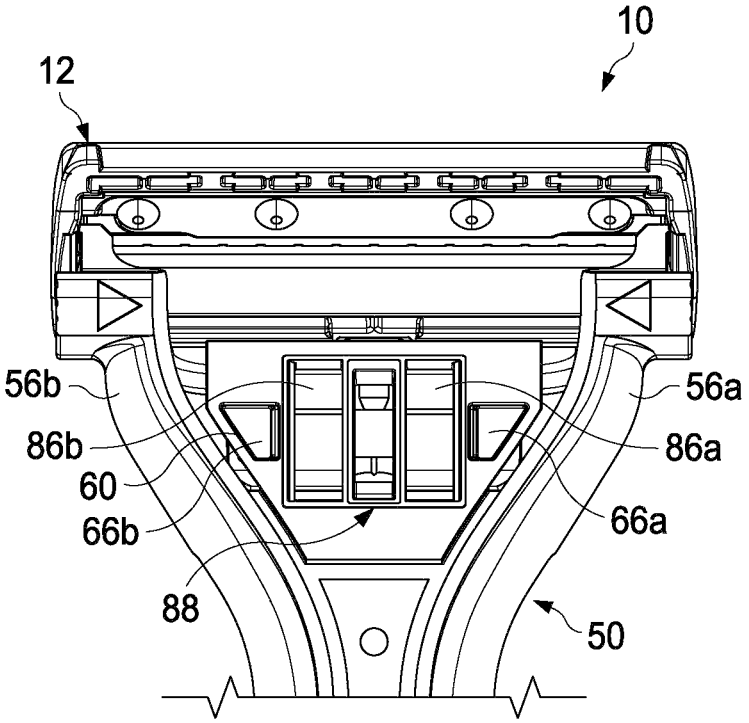
FIG. 3 is an enlarged partial top view the hair removal device of FIG. 1.

The consumer needs for emerging and developed markets require economical and intuitive hair removal devices (e.g., shaving razors) that include modern advantages, such as replaceable cartridges that follow the contours of the face during shaving and do not unintentionally disengage from the handle. When the cartridge is to be replaced, the cartridge should be able to be removed from the handle in simple and intuitive manner. Furthermore, the cartridge should not unintentionally disengage the handle during use. Once the dispensing unit 150 is positioned properly within the handle 50, the cover 60 may be mounted over the dispensing unit 150 and onto the handle 50. The cover 60 may have one or more cartridge retention members 66*a* and 66*b*. As shown in FIG. 3, the cartridge retention members 66*a* and 66*b* may be positioned between the pair of arms 56*a* and 56*b* of the handle 50 to prevent the arms 56*a* and 56*b* from flexing together and disengaging the cartridge 12. The cartridge retention members 66*a* and 66*b* may be positioned between the pair of arms 56*a* and 56*b* when the cover 60 is in a closed position (i.e., the cover 60 is securely mounted to the handle 50). The cartridge retention members 66*a* and 66*b* may directly contact the pair of arms 56*a* and 56*b* to prevent the arms 56*a* and 56*b* from moving closer together and disengaging from the cartridge 12. When the cover 60 is not mounted to the handle 50 (i.e., cover 60 is in an open position), the cartridge retention members 66*a* and 66*b* may be spaced apart from the arms 56*a* and 56*b* (i.e., not located between the arms 56*a* and 56*b*) allowing the arms 56*a* and 56*b* of the cartridge 12 to flex toward each other from a first position (i.e., a neutral position) to a second position. The arms 56*a* and 56*b* may be closer together in the second position to allow the handle 50 to engage and/or disengage the cartridge 12. The arms 56*a* and 56*b* may each have a pin member 58*a* and 58*b* that pivotably engages a corresponding opening 16*a* and 16*b* within the cartridge 12. For example, the pin members 58*a* and 58*b* may be positioned within the openings 16*a* and 16*b*. In certain embodiments, the openings 16*a* and 16*b* may extend completely through a pair of opposing lateral end walls 18*a* and 18*b* of the cartridge 12 for improved engagement.

In certain embodiments, the dispensing unit 150 is assembled to the handle 50 after the cartridge 12 is mounted to the handle 50 so the applicator 100 is properly positioned. The dispensing unit 150 may be placed within the cavity 70 of the handle 50. The reservoir connector 164 and the pump connector 162 may be placed between the interiors walls 72 and 74. The alignment members 102 and 104 of the applicator 100 may mount to the alignment members 82 and 84 of the handle 50. The cover 64 (with attached actuator 62) may be mounted to the handle 50 to secure the cartridge 12 and the dispensing unit 100. In certain embodiments, the cover 60 may have one or more tabs 68 toward one end of the cover 60 and one or more tabs 86*a* and 86*b* toward an opposite end of the cover 60 to help secure the cover 60 to the handle 50. The tab 68 may engage a notch 69 of the handle 50. The cover 60 may then be pivoted to force the dispensing unit 150 further into the cavity 70 and force the reservoir connector 164 and the pump connector 162 closer together to activate the dispensing unit. As shown in FIG. 3, the tabs 86*a* and 86*b* may be releasably secured within an opening 88 of the handle 50.

Figure 4:
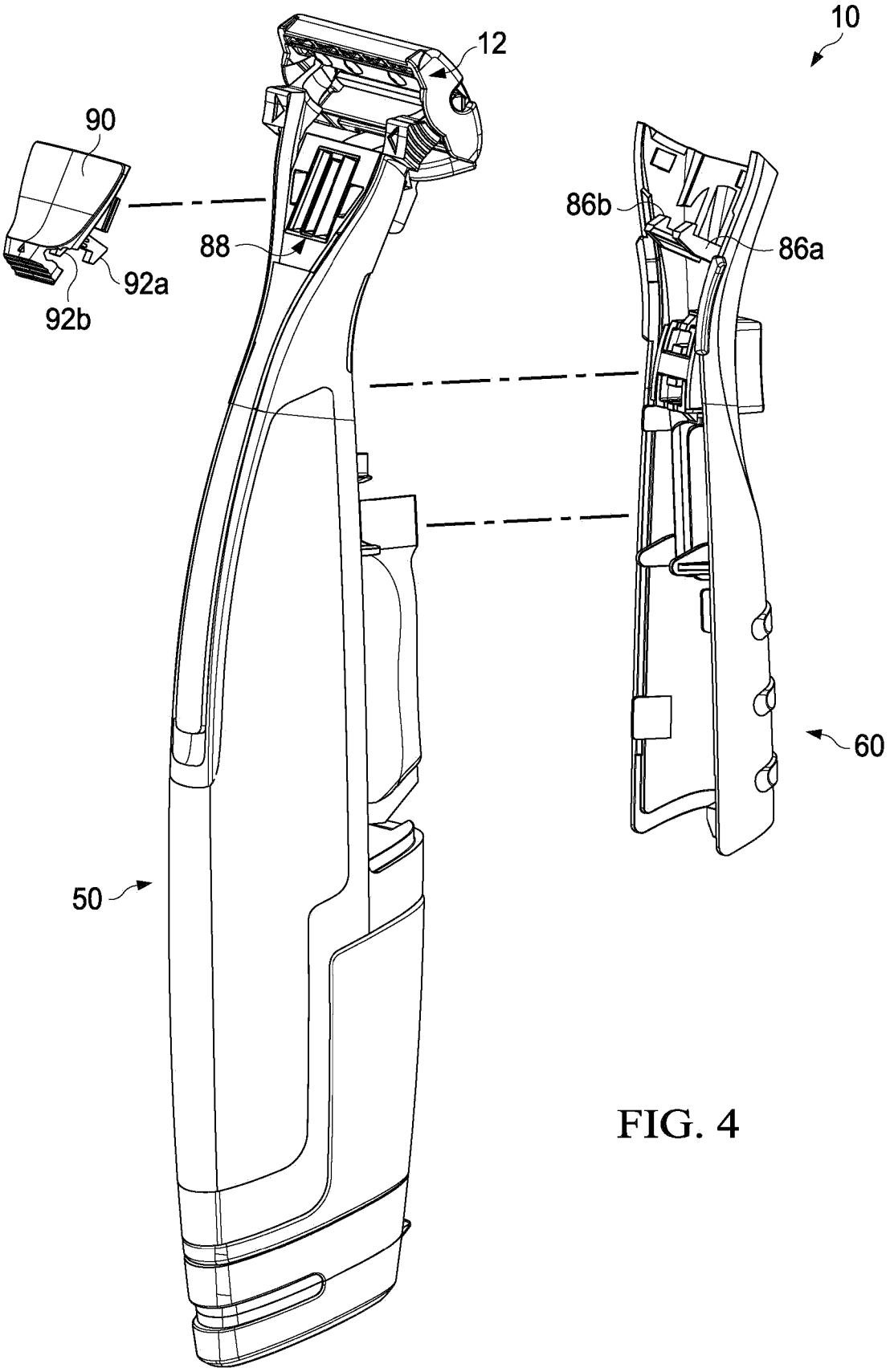
FIG. 4 is a side assembly view of the hair removal device of FIG. 1.

Referring to FIG. 4, a perspective assembly view of the hair removal device 10 is shown illustrating the cover 60 being mounted to the handle 50. The hair removal device 10 may have a release member 90 that slidingly engages the handle 50. The release member 90 may have one or more of tabs 92*a* and 92*b* that extend into the opening 88 in the handle 50 and engage the corresponding one or more tabs 86*a* and 86*b* of the cover 60. The release member 90 may have a first position such that the tabs 92*a* and 92*b* are securely engaged with the corresponding tabs 86*a* and 86*b*. The release member 92 may be actuated to a second position such that the tabs 90*a* and 90*b* move forward (e.g., toward the cartridge 12) and disengage the tabs 86*a* and 86*b* to release the cover 60 from the handle 50.

Figure 5:
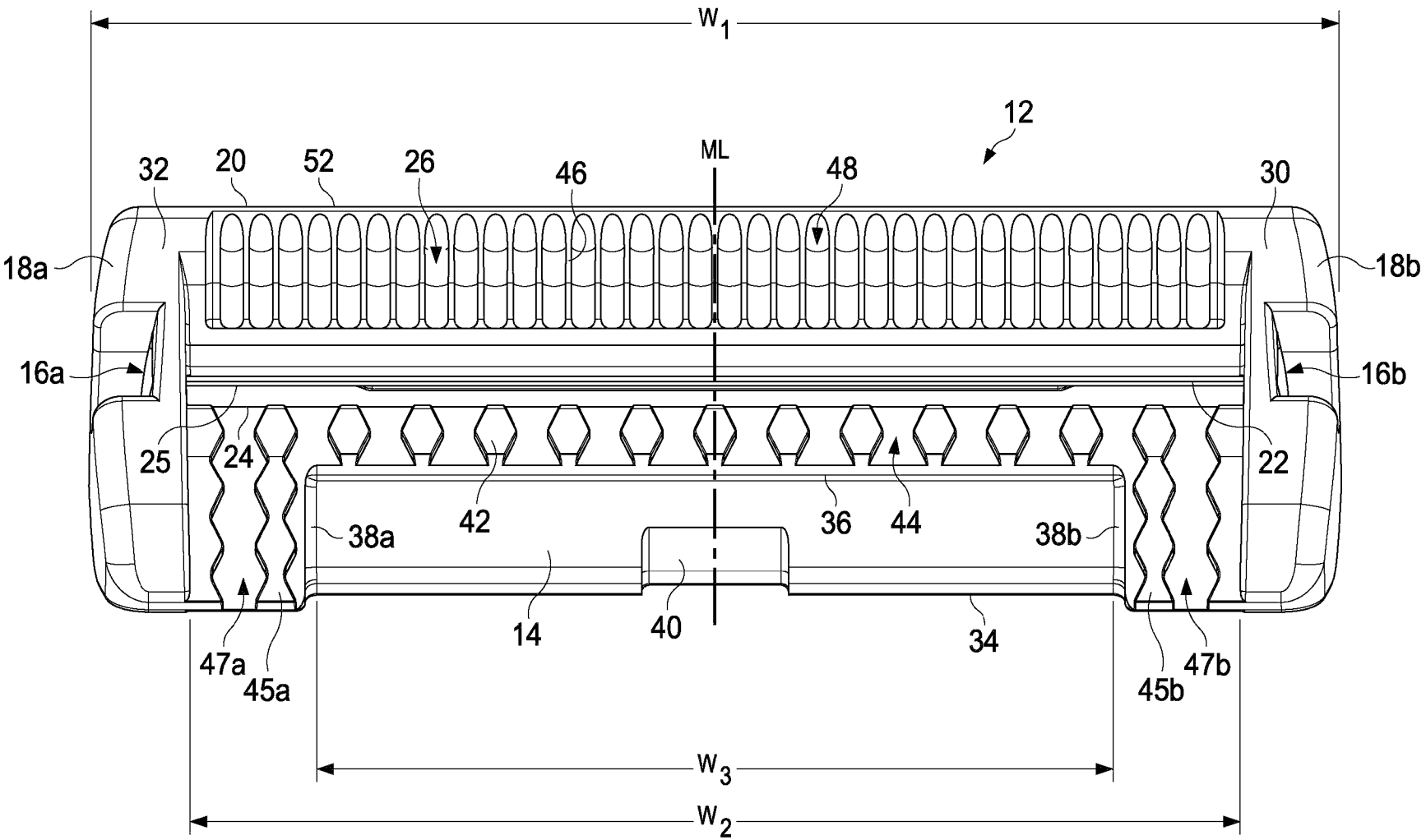
FIG. 5 is a top view of a cartridge which may be incorporated into the hair removal device of FIG. 1.

Referring to FIG. 5, a top view of the cartridge 12 is shown. The cartridge 12 may have an overall width "$w_1$" from one lateral end 18*a* to the other lateral end 18*b* of about 30 mm, 35 mm, or 40 mm to about 45 mm, 50 mm, or 55 mm. The cartridge 12 may include a housing 20 dimensioned to receive at least one blade 22 having a blade edge 25. The housing 20 may be injection molded from a semi-rigid polymeric material, such as high impact polystyrene. The housing 20 may be molded from other semi-rigid polymers having a Shore D hardness of about 60 to 140, including, but not limited to Noryl™ (a blend of polyphenylene oxide (PPO) and polystyrene developed by General Electric Plastics, now SABIC Innovative Plastics), acrylonitrile butadiene styrene (ABS), acetal, polypropylene, high impact polystyrene, or any combinations thereof. The blade 22 may be a cutting blade (e.g., for a shaving razor), a scraping blade (e.g., for a depilatory device), or a pulling blade (e.g., for an epilator). Although one blade 22 is shown, the cartridge 12 may have more blades 22 depending on the desired performance and cost of the cartridge 12 and the hair removal device 10. In certain embodiments, the blade 22 may be mounted to the housing 20 and secured by cold staking. Other assembly methods known to those skilled in the art may also be used to secure and/or mount the blade 22 to the housing 20 including, but not limited to, wire wrapping, clips, hot staking, insert molding, ultrasonic welding, and adhesives.

The housing 20 may have a guard 24 in front of the blade 22 and a cap 26 behind the blade 16. The guard 24 may extend parallel to the blade 22 between the lateral ends 18*a* and 18*b*. The guard 24 may have an overall width "$w_2$" of about 25 mm, 30 mm, or 35 mm to about 40 mm, 45 mm, or 50 mm. In certain embodiments, the overall width $w_2$ of the guard 24 may be about 75%, 80%, or 85% to about 90%, 95%, or 100% of the overall width $w_1$ of the cartridge 12. The housing 20 may have a top surface 30 and 32 that extends from the guard 24 to the cap 26. In certain embodiments, the openings 16*a* and 16*b* may extend through the respective top surface 30 and 32. The housing 20 may have a front end wall 34 extending between the lateral ends 18*a* and 18*b*. The elongated recess 14 may extend from the front end wall 34 toward the blade 22. The guard 24 may have an interior rear wall 36 and a pair of interior lateral walls 38*a* and 38*b* that define the elongated recess 14. The elongated recess 14 may extend parallel to the blade 16. The elongated recess 14 may have an overall width "$w_3$" of about 36 mm between the pair of interior lateral walls 38*a* and 38*b*. The overall width "$w_3$" may be greater than an overall length between the front end wall 34 and the interior rear wall 36. The ratio of the overall width of the elongated recess 14 to the overall length of the elongated recess 14 may be about 4:1, 5:1, or 6:1, to about 7:1, 8:1, or 9:1. In certain embodiments, the overall width $w_3$ of the elongated recess 14 may be about 70%, 75%, or 80% to about 85%, 90% or 100% of the overall width of the housing 20 and/or guard 24. For example, the overall width $w_3$ may be about 15 mm, 20 mm, or 25 mm to about 30 mm, 40 mm, or 55 mm. The elongated recess 14 may have a depth (as measured from the top of the guard 24) of about 0.2 mm, 0.25 mm, or 0.3 mm to about 0.4 mm, 0.5 mm, or 0.6 mm. The front end wall 34 of the housing 20 may define a notch 40 that extends into the guard 24. The notch 40 may be positioned within the elongated recess 14 toward a midline "ML" of the housing 20. The notch 40 may engage at least a portion of the applicator 100. The notch 40 may aid in maintaining the applicator 100 positioned within the recess 14 of the housing 20 during use. The notch 40 may have a depth (as measured from the top of the recess 14) of about 0.2 mm, 0.25 mm, or 0.3 mm to about 0.4 mm, 0.5 mm, or 0.6 mm.

The guard 24 may have one or more projections 42 behind the elongated recess 14 that are positioned along the overall width of the guard 24 (e.g., along about 70% to about 100% the overall width of the guard 24). The projections 42 can have different sizes, shapes and geometries. In particular, the projections 42 can be in the form of nubs or fin segments that are spaced apart or interconnected. The projections 42 may also have different patterns or may be oriented at different angles with respect to the blades, e.g., in zigzag, chevron, herringbone or checkerboard patterns. The projections 42 can also take the form of spaced fin segments that are arranged in rows oriented generally parallel to the blades or spaced fin segments that are arranged both parallel to and perpendicular to the blades. The projections 42 may also represent a raised area around one or more recesses in the guard 24. In certain embodiments, the projections 42 may be spaced apart to define one or more open channels 44 extending transverse to the blade 22. The guard 24 may have one or more lateral projections 45*a* and 45*b* on either side of the elongated recess 14 (i.e., between lateral end wall 18*a* and the interior lateral wall 38*a* and between lateral end wall 18*b* and the interior lateral wall 38*b*). The lateral projections 45*a* and 45*b* may be spaced apart to define one or more open channels 47*a* and 47*b* extending transverse to the blade 22. The lateral projections 45*a* and 45*b* may also define one or more open channels 47*a* and 47*b* with the respective lateral end walls 18*a* and 18*b*.

The projections 42 (and the lateral projections 45*a* and 45*b*) may be configured for the management of skin and may aid in guiding hair and liquid toward the blade 30. The guard 24 may be integral with the housing 20 and molded from polymeric materials such as high impact polystyrene (HIPS). The guard 24 may be molded from other semi-rigid polymers having a Shore D hardness of about 60 to 140, including, but not limited to Noryl™ (a blend of polyphenylene oxide (PPO) and polystyrene developed by General Electric Plastics, now SABIC Innovative Plastics), acrylonitrile butadiene styrene (ABS), acetal, polypropylene, high impact polystyrene, or any combinations thereof. Alternatively, the guard 24 and/or the projections 42 may be molded from a different polymer than the housing 20. In certain embodiments, the guard 24 and/or the projections 42 may be molded from a softer material than the housing 20. For example, the guard 24 and/or the projections 42 may be molded from materials having a Shore A hardness of about 20 to about 70, such as thermoplastic elastomers (TPEs), silicones, or rubbers.

A cap having a generally uniform surface may create a significant amount of friction and drag as the cartridge is passed along the surface of the skin. This is typically why caps include a shaving aid composite to deliver a lubricious substance to the user's skin. The cap 26 may have a plurality of ribs 46 that define a plurality of grooves 48 that extend generally traverse to the blade 22. The ribs 46 may support the skin along a substantial length of the blade 20 for a more comfortable shave. The ribs 46 also reduce the overall surface contact area with the skin. The surface contact area with the skin may be the total surface area of the top surface of all of the ribs 46 that come into contact with the surface of the skin during shaving. The ribs 46 may have either a generally flat top surface or a generally curved top surface. The top surface of the ribs 46 may reduce the contact area of the cap 26 by about 30%, 40%, or 50% to about 60%, 70% or 80%. For example, if the cap 26 had a generally uniform surface with no ribs the skin surface contact area would be about 140 $mm^2$. However, the skin surface contact area of the cap 26, as shown with ribs 46, may be about 30 $mm^2$ (a 79% decrease in skin surface contact area). In certain embodiments, the skin surface contact area of the cap 26 may be about 25 $mm^2$, 35 $mm^2$, 45 $mm^2$, or 55 $mm^2$ to about 75 $mm^2$, 85 $mm^2$, or 95 $mm^2$ The ribs 46 may be generally rectangular or trapezoid in cross-section with an aspect ratio of about less than 2:1, such that a base of the rib 46 is generally the same size as a top surface of the rib 16. For example, the ribs 46 may have an aspect ratio of about 1:1, 1:1.3, or 1:1.5 to about 1:1.6, 1:1.7, or 1:1.9. A greater aspect ratio may cause the ribs 46 to scrape the user's skin resulting in an uncomfortable experience. A top surface of the ribs 46 may be generally flat with a smooth finish to reduce drag against the surface of the skin. The ribs 46 may be generally equidistantly spaced and may generally extend the entire length of the cap 26. Alternatively, the ribs 46 may extend about 70% to about 95% the length of the cap 26. The ribs 46 may have a pitch of about 0.25 mm, 0.50 mm, or 0.70 mm to about 1.0 mm, 1.25 mm, or 1.5 mm.

The grooves 48 may have a depth of about 0.05 mm, 0.1 mm, or 0.2 mm to about 0.25 mm, 0.4 mm, or 0.6 mm. In certain embodiments, the ribs 46 and the grooves 48 may extend at least to a back end wall 52 of the housing 20. The back end wall 52 may be curved to provide for a smooth transition from the cap 26. The ribs 46 and the grooves 48 may also be curved as they transition to the back end wall 52. The grooves 48 may provide a path for removing excess shave prep from the surface of the skin during shaving. The removal of shave prep tends to be an indicator for most users that a certain area of skin has been adequately shaved. If shave prep is left behind, a consumer may unnecessarily shave the area again, thus increasing the probability of nicks and cuts. The grooves 48 may be generally concave, which may improve the rinsing of the cap 26. Channels with sharp corners or ribs with straight edges may be difficult to rinse, thus leaving behind trapped shaving aid and shaving debris.

Usually shaving cartridges include a shaving aid, such as a lubricating strip joined to the cap or the cap may include a shaving aid composite to deliver a lubricious substance to the user's skin. Although these types of caps with lubricating strips and lubricating substances are very lubricious when wet, they may become too lubricous for a shaving razor that dispenses a shaving aid. Furthermore, lubricating strips can increase the cost of the cartridge. In addition, the surface containing the lubricating substances may become rough and pitted over time as the lubricating strip or shaving composite wear away. The user often has to replace the cartridge, not because the blade is dull, but because the cap (lubricating strip) no longer provides a lubricous or comfortable shave. The wearing away of the lubricating substances in certain razors is even more problematic because the cap and lubricating strip are used to achieve the shaving angle of the blade. As the lubricating substances wear, the shaving angle may change, resulting in a more aggressive and uncomfortable shave. In certain areas of the world shaving razors are not used and stored in controlled environments, and are thus more susceptible to heat and humidity. The lubricating substances may experience even greater wear and dry out faster in hot environments. The shaving aid composite of the cap may release lubricious substances unnecessarily when the shaving cartridge is not being used, especially in areas of the world with increased humidity. The cap 26 may provide a cost effective alternative to caps that include a lubricating strip joined to the cap or caps having a shaving aid composite that delivers a lubricious substance. The cap 26 may provide for a consistent shaving angle and allow for adequate lubricity and comfort.

The cap 26 may be integral with the housing 20 or molded separately and then assembled to the housing 20. The cap may be molded from polymers such as high impact polystyrene (HIPS), but other semi-rigid polymers such as polypropylene (PP) and acrylonitrile butadiene styrene (ABS) may also be used. Semi-rigid materials, such as polystyrene based plastics, maintain the cap 26 and the housing 20 geometry during shaving, thus further reducing drag and friction against the surface of the skin. Additives such as silicone, PTFE or PPO may be added to the polymer to improve surface lubricity of the cap 26 against the skin surface during shaving. In certain embodiments, the cap 26 may be integral with the housing 20.

The material the cap 26 is composed of may not degrade or wear over time so the cap 26 maintains its geometry independent of the blade 22 becoming dull. The user may be able to get more shaves from the same cartridge 12 because cartridge 12 would need to be replaced only when the blade 22 becomes too dull, which may vary greatly depending on the user. The cartridge 12 would not need to be prematurely replaced because of discomfort that is the result of a worn cap 26.

In certain embodiments, the cap 26 may be molded from a shaving aid to provide increased lubrication to the surface of the skin during shaving. Alternatively the cap 26 may have a separate molded or extruded component that is assembled to the housing 20. For example, the housing 20 may have a shaving aid strip mounted to the cap 26. Shaving aid strips may comprise a matrix of a water-insoluble polymer and, dispersed within the matrix, a skin lubricating water-soluble polymer. Alternatively, the shaving aid composition may comprise a sheath of water-insoluble polymer that surrounds a core which includes a skin-lubricating water-soluble polymer. Suitable water-insoluble polymers which can be used for the matrix (or sheath) include polyethylene, polypropylene, polystyrene, butadiene-styrene copolymer (e.g., medium and high impact polystyrene), polyacetal, acrylonitrile-butadiene-styrene copolymer, ethylene vinyl acetate copolymer and blends such as polypropylene/polystyrene blend, most preferably a high impact polystyrene (i.e., Polystyrene-butadiene), such as Mobil 4324 (Mobil Corporation). Suitable skin lubricating water-soluble polymers include polyethylene oxide, polyvinyl pyrrolidone, polyacrylamide, hydroxypropyl cellulose, polyvinyl imidazoline, and polyhydroxyethylmethacrylate. Other water-soluble polymers may include the polyethylene oxides generally known as POLYOX (available from Union Carbide Corporation) or ALKOX (available from Meisei Chemical Works, Kyota, Japan). These polyethylene oxides will preferably have molecular weights of about 100,000 to 6 million, most preferably about 300,000 to 5 million. The polyethylene oxide may comprise a blend of about 40 to 80% of polyethylene oxide having an average molecular weight of about 5 million (e.g., POLYOX COAGULANT) and about 60 to 20% of polyethylene oxide having an average molecular weight of about 300,000 (e.g., POLYOX WSR-N-750). The polyethylene oxide blend may also advantageously contain up to about 10% by weight of a low molecular weight (i.e., MW<10,000) polyethylene glycol such as PEG-100. The shaving aid composition may also optionally include an inclusion complex of a skin-soothing agent with a cylcodextrin, low molecular weight water-soluble release enhancing agents such as polyethylene glycol (e.g., 1-10% by weight), water-swellable release enhancing agents such as cross-linked polyacrylics (e.g., 2-7% by weight), colorants, antioxidants, preservatives, microbicidal agents, beard softeners, astringents, depilatories, medicinal agents, conditioning agents, cooling agents, etc.

Figure 6:
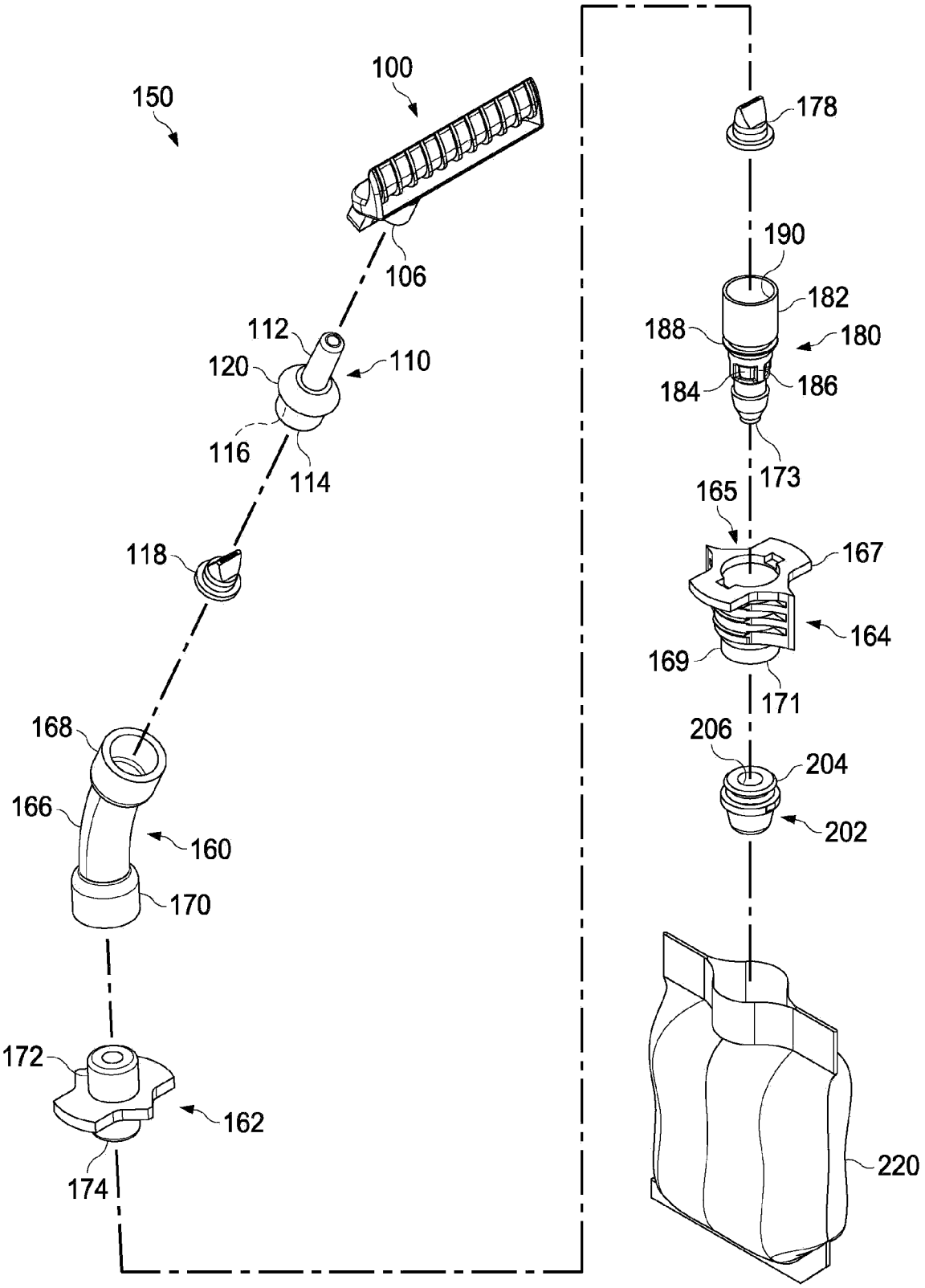
FIG. 6 is an assembly view of a dispensing unit which may be incorporated into the hair removal device of FIG. 1.

Referring to FIG. 6, an assembly view of the dispensing unit 150 is illustrated. The dispensing unit 150 may have a hollow applicator connector 110 coupled to and in liquid communication with the applicator 100. For example, one end 112 the applicator connector 110 may be press fit within an opening 106 of the applicator 100. The applicator connector 110 may comprise a semi-rid polymeric material and the applicator 100 may comprise a resilient polymeric material that conforms around the end 112 of the applicator connector 110. The applicator connector 110 may have a second end 114 with an opening 116 dimensioned to receive a first valve 118. The second end 114 of the applicator connector 110 may be coupled to and in liquid communication with the pump 160. The pump 160 may comprise an elongated resilient tube 166 having a first end 168 press fit over the second end 114 of the applicator connector 110. The applicator connector 110 may have shoulder 120 to prevent the pump 160 from extending to far over the applicator connector 110, which may cause the first valve 118 to travel out of the second end 114 of the applicator connector and become lodged within the resilient tube 166. If the first valve 118 becomes lodged within the resilient tube 166, the dispensing unit 150 may become inoperable or may leak. The resilient tube 166 may have a second end 170 coupled to an in liquid communication with pump connector 162. The pump connector 162 may be semi-rigid and have a first end 172 press fit into the second end 170 of the resilient tube 166. The pump connector 162 may have a second end 174 with an opening 176 extending through the pump connector 162. The opening 176 may be dimensioned to receive a second valve 178 (e.g., a duckbill valve). The valves 118 and 178 may be one way valves (e.g., check valves, clack valves, and non-return valves) that are connected in series. Examples of one way valves that may be used include, but not limited to ball check valves, swing check valves or tilting disc check valves, stop-check valves, lift-check valves, and duckbill valves. The positioning of the valves 118 and 178 within the applicator connector 110 and the pump connector 162 saves space and also helps prevent the valves 118 and 178 from moving out of position.

The dispensing unit 150 may have a reservoir conduit 180 with a first end 182 and a second end 184 with one or more apertures 186 extending through an outer wall 188 of the second end 184. The first end 182 may be coupled to and in liquid communication with the second end 174 of the pump connector 162. For example, the first end 182 may have an opening 190 that is press fit over the second end 174 of the pump connector 162. The second end 184 of the reservoir conduit 180 may fit within an opening 165 of a first end 167 of the reservoir connector 164. The reservoir 220 may be sealed around the reservoir connector 164 such that at least a second end 169 of the reservoir connector 164 within the reservoir 220. The second end 169 of the reservoir connector 164 may have an opening 171 dimensioned to receive a plug 202. The plug 202 may have a first end 204 with a recess 206. A distal end 173 of the reservoir connector 164 may fit within the recess 206 of the plug 202.

Figure 7A:
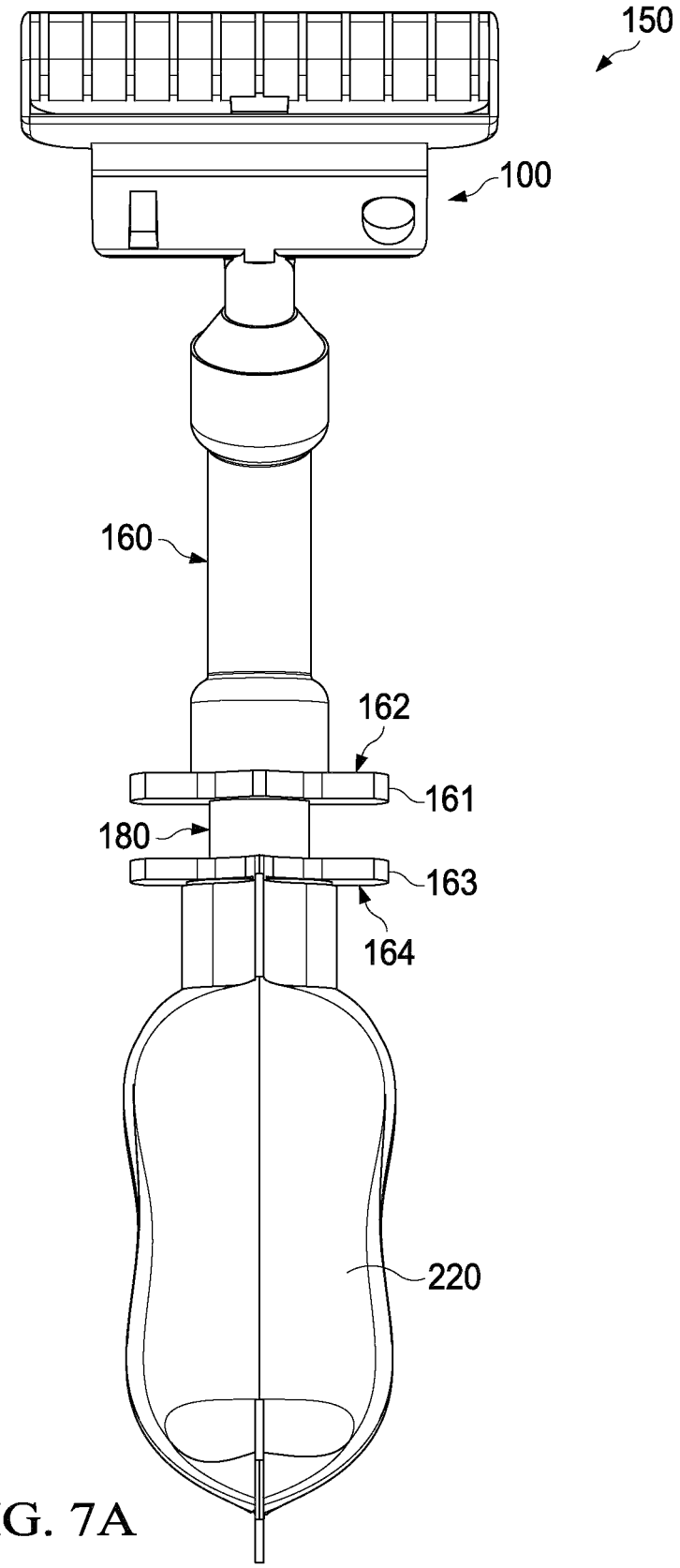
FIG. 7A is a bottom view of the dispensing unit of FIG. 6 in a first position.
Figure 7B:
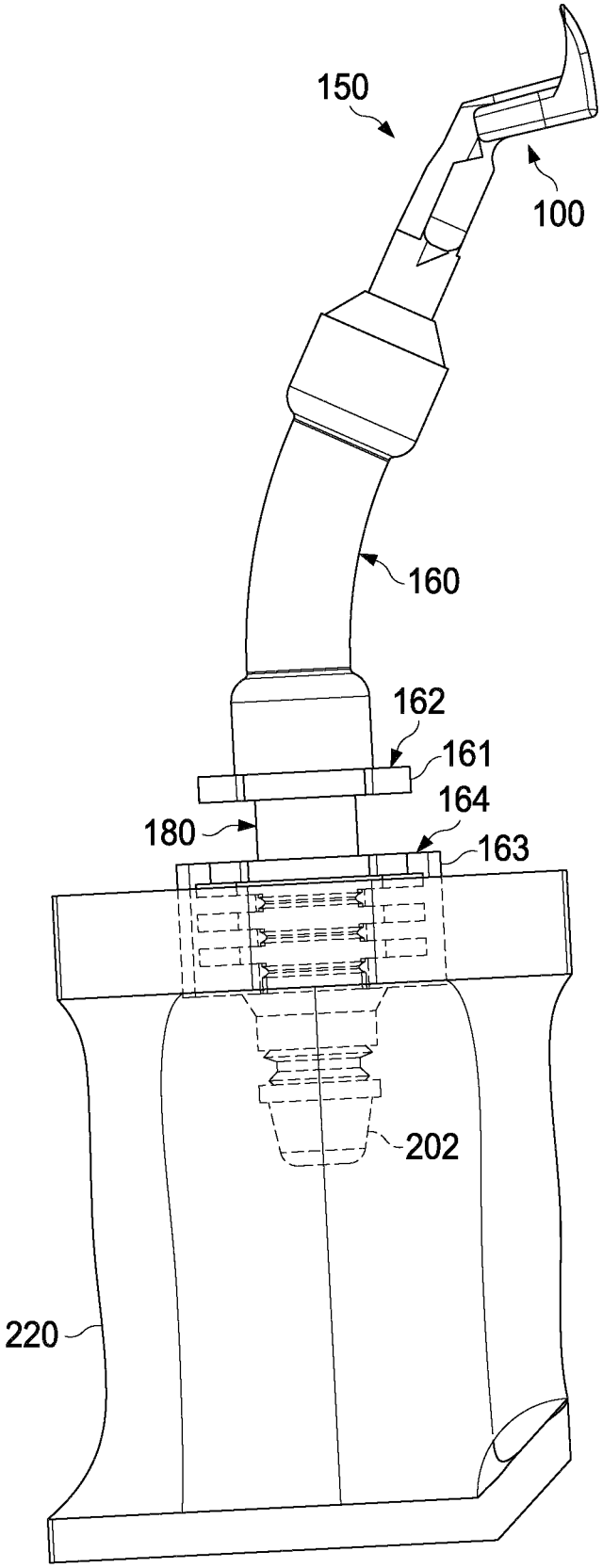
FIG. 7B is a side view of the dispensing unit of FIG. 6 in a first position.

Referring to FIGS. 7A and 7B, the dispensing unit 150 is shown in the first position (i.e., sealed position). FIG. 7B illustrates the reservoir 220 as transparent strictly to show the inside of the reservoir and aid in the description of the dispensing unit 150. In the first position, the pump 160 and the applicator 100 may not be in liquid communication with the reservoir 220. The pump connector 162 may have a shoulder 161 that is spaced apart from a shoulder 163 of the reservoir connector 164 in the first position. In addition, the second end 184 (not visible in FIGS. 7A and 7B) of the reservoir conduit 180 may be positioned within the reservoir connector 164. The apertures 186 (not visible in FIGS. 7A and 7B) of the reservoir conduit 180 may be blocked by the reservoir connector 164 and/or the plug 202 to prevent the flow of liquid from the reservoir 220 to the pump 160. Accordingly, the applicator 100 and the pump 160 are not in liquid communication with the reservoir 220 in the first position and the pump 160 is unable to transport liquid from the reservoir 220 to the applicator 100.

Figure 8A:
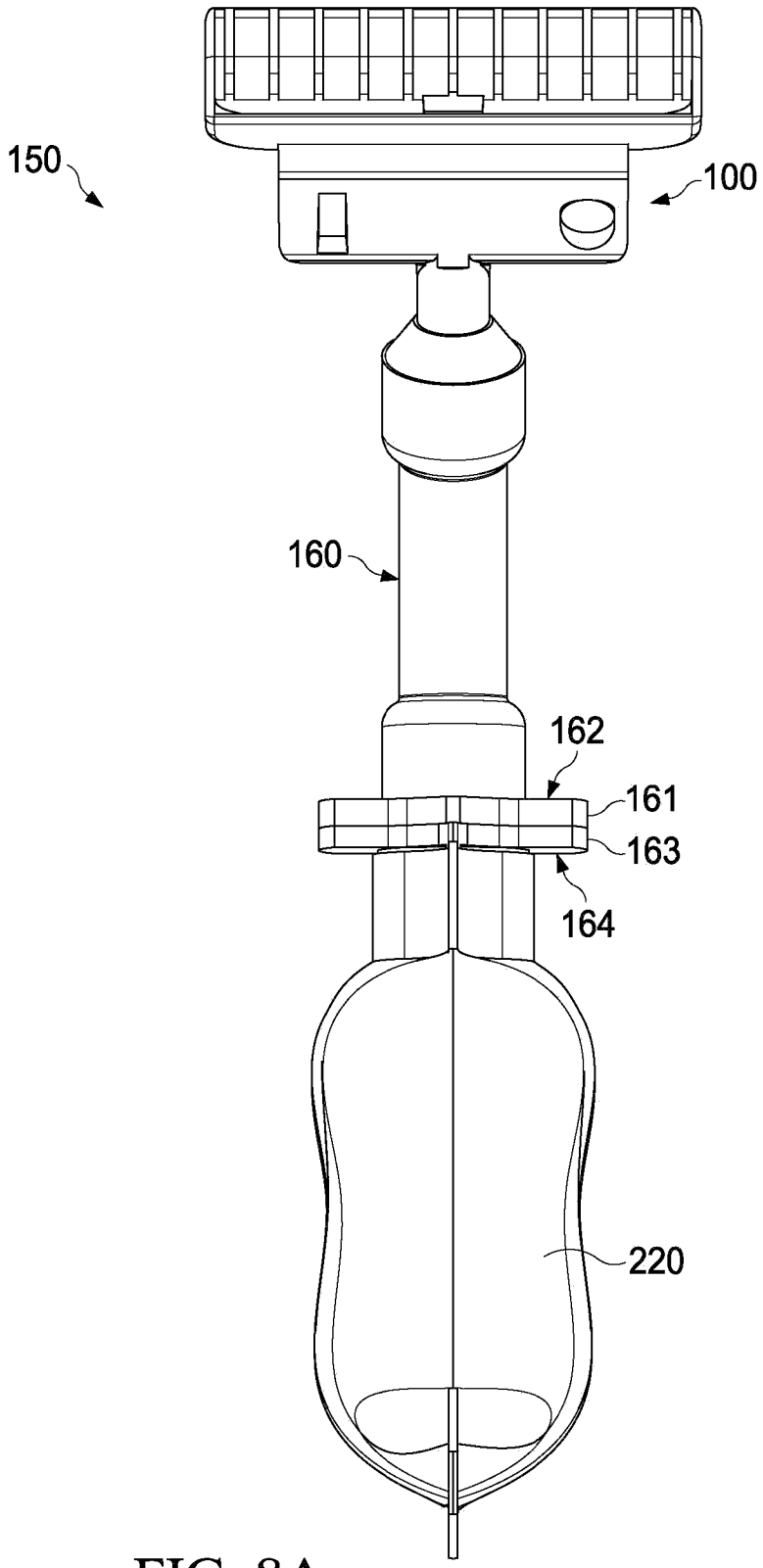
FIG. 8A is a bottom view of the dispensing unit of FIG. 6 in a second position.
Figure 8B:
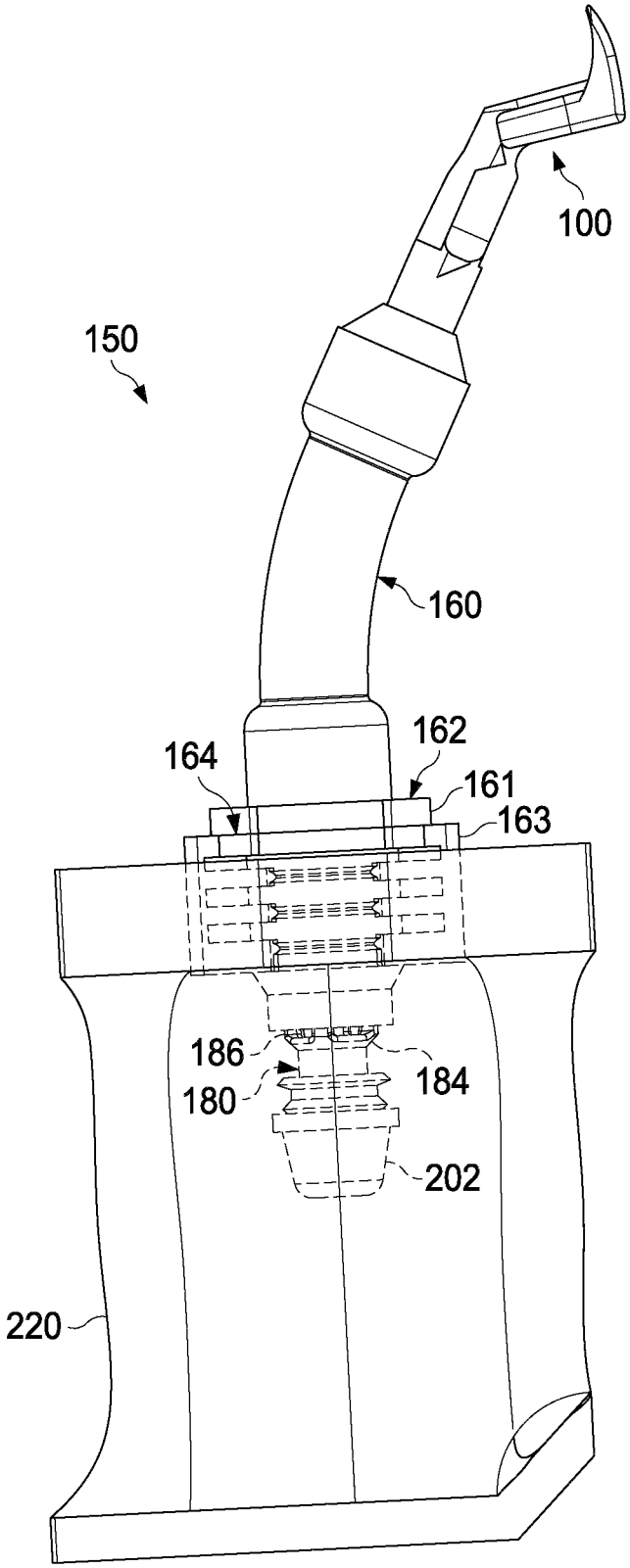
FIG. 8B is a side view of the dispensing unit of FIG. 6 in a second position.

As shown in FIGS. 8A and 8B, the pump connector 162 and/or the reservoir connector 164 may be moved from the second position (e.g., activated position). In the second position, the shoulder 161 of the pump connector 162 may be in contact with the shoulder 163 of the reservoir connector 164. It is understood that in the second position the shoulders 161 and 163 may be moved closer together, but may or may not be direct contact. In addition, the second end 184 of the reservoir conduit 180 may extend out from the reservoir connector 164 such that the apertures 186 of the reservoir conduit 180 are no longer blocked by the reservoir connector 164 preventing the flow of liquid from the reservoir 220 to the pump 160. Accordingly, the applicator 100 and the pump 160 may be in liquid communication with the reservoir 220 because liquid is able to enter the apertures 186 of the reservoir conduit 180 and flow through reservoir conduit 180 to the pump 160. The pump 160 may then be able to transport the liquid to the applicator 100. In certain embodiments, the second position may be permanent (i.e., once the dispensing unit 150 is in the second position, it is locked and can not be moved back to the first position). Once the reservoir is emptied, the reservoir may not be able to be refilled and resealed, (and thus resold). Accordingly, the consumer knows that when they buy the dispensing unit 150 in the first position the contents are sealed and not contaminated. Also the consumer knows that the liquid contained in the reservoir 220 is consistent with the ingredients listed on the package by the original manufacturer.

The dispensing unit 150 may be sold as a separate consumable that the consumer purchases and inserts into the hair removal device 10 to activate the dispensing unit 150. The dispensing unit 150 may also be sold with the hair removal device 10. The dispensing unit 150 may be either in the first position (i.e., sealed) or the second position (i.e., activated) when sold with the hair removal device 10. As previously explained above, in certain embodiments, it may be advantageous for the shoulders 161 and 163 to be forced together by the handle 50 and the cover 60 during assembly of the hair removal device 10. Alternatively, the consumer may move shoulders 161 and 163 together by hand. However, due to space constraints the pump connector 162 and the reservoir connector 164 are relatively small; therefore, it may be difficult for the consumer to apply enough force to move the pump connector 162 and/or the reservoir connector 164 to the second position. In certain embodiments, the dispensing unit 150 and/or the handle 50 may provide an audible feedback, such as a "click" sound, when the dispensing unit 150 is placed in the second position. The audible feedback may be produced by the pump connector 162 and the reservoir connector 164 moving together or the reservoir conduit 180 moving relative to the reservoir connector 164. The audible feedback may also be produced from the dispensing unit 150 fully engaging the handle 50 (e.g., when the cover 60 is mounted to the handle 50). The cover 60 engaging the handle 50 (e.g., the cover 60 engaging the release member, as shown in FIG. 4) may also produce audible feedback signaling to the consumer the dispensing unit 150 is activated.

Figure 9A:
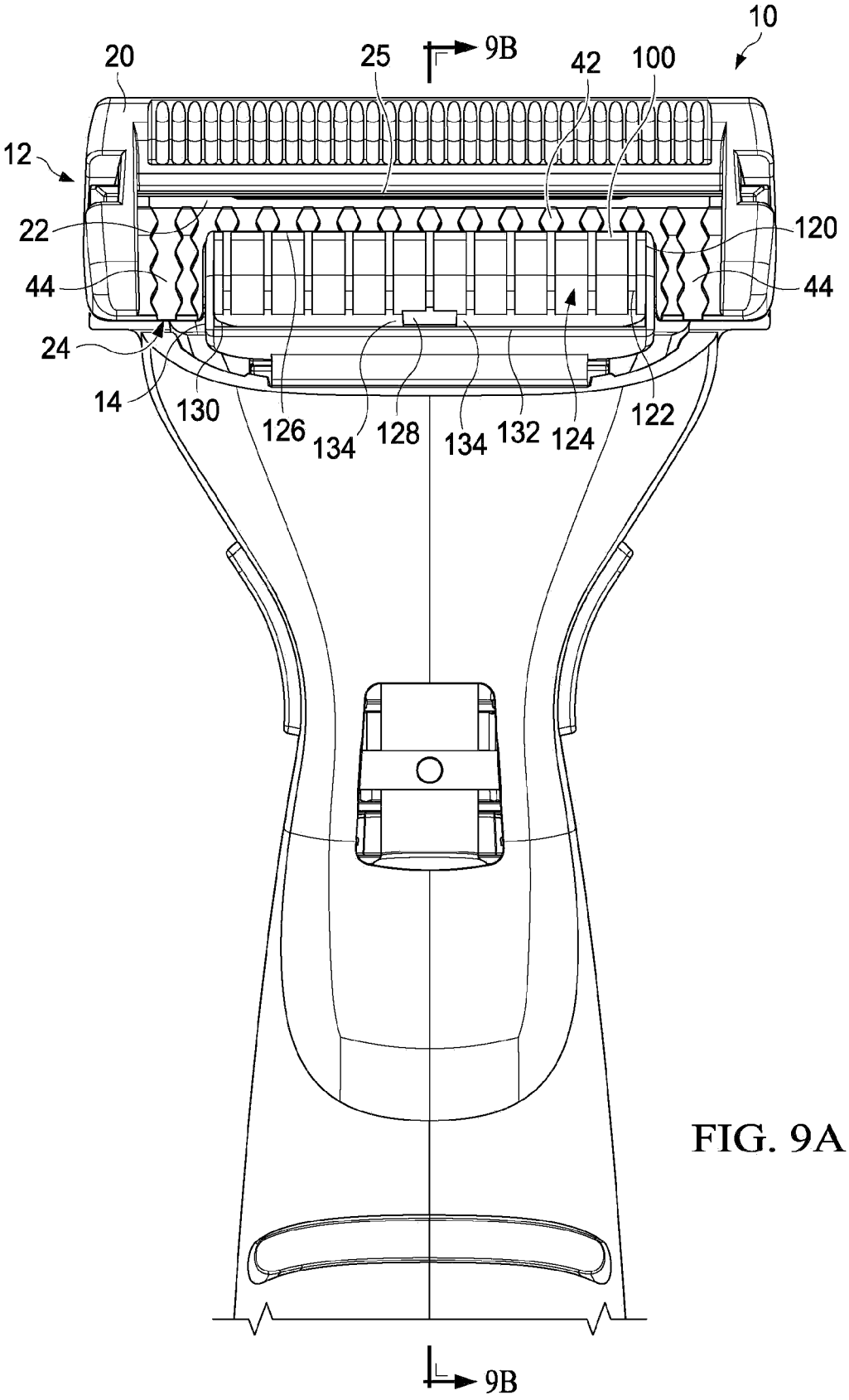
FIG. 9A is an enlarged partial bottom view of the hair removal device of FIG. 1.

Referring to FIG. 9A, an enlarged bottom view of the hair removal device 10 is shown. The applicator 100 may have a guard 120 with a plurality of ribs 122 that define a plurality of open channels 124 that are transverse to the blade 22 (e.g., the blade edge 25). The applicator 100 may have at least one outlet port 128 in front of the guard 120 on the same side as the blade 22. In certain embodiments, the applicator 100 may have only a single outlet port 128. The outlet port 128 may be positioned toward a midline of the applicator 100 (e.g., along line 9B-9B). The projections 42 of the guard 24 may be aligned with the ribs 122 of the applicator 100 to define a plurality of open channels 126 extending transverse to the blade 22 (i.e., the channels 44 of cartridge guard 24 may be aligned with the channels 124 of the applicator guard 120). Liquid may be travel from the outlet port 128 and through the open channels 126 of the guard 120 and toward the blade 22. The applicator 100 may also apply a layer of the liquid to the surface of the skin during a stroke of the hair removal device 10 against the skin. The ribs 122 may prevent erratic glide of cartridge 12 over the face during a shaving stroke. In addition, the ribs 122 may decrease surface area in contact with skin and provide channels for liquid to flow toward the blade 22 for increased lubrication and a more comfortable shave.

The applicator 100 may have a baffle 130 in front of the guard 120 with a resilient front wall 132 that defines an elongated recess 134. The baffle 130 may allow for increased dispersement of fluid to a wider surface of the skin. The elongated recess 134 of the baffle 130 may have a width of about 15 mm, 20 mm, or 25 mm to about 30 mm, 35 mm, or 40 mm. The elongated recess 134 may have a length of about 1.5 mm, 2.0 mm, or 2.5 mm to about 3.0 mm, 3.5 mm, or 4.0 mm. The depth of the elongated recess 134 may be greater than the width of the elongated recess 134. In certain embodiments, the depth of the elongated recess 134 may be about 3 mm, 4 mm, or 5 mm to about 6 mm, 7 mm, or 8 mm. The outlet port 128 may be positioned within the elongated recess 134. The baffle 130 may control the flow of liquid from the outlet port 128 to the guard 120 of the applicator 100. The elongated recess 134 may be filled with liquid that is pumped from the reservoir 220 (not shown) to the outlet port 128. The elongated recess 134 may have a first volume of about 0.2 ml to about 0.5 ml when the resilient front wall 132 is in a first position and a second volume when the flexible front wall is in a second position. The resilient front wall 132 may flex from the first position to the second position during a stroke (e.g., a shaving stroke) of the hair removal device 10 to disperse liquid contained within the elongated recess 134 toward the guard 120 of the applicator 100. In certain embodiments, the second volume may be about 35%, 45%, or 55% to about 75%, 85%, or 95% less than the first volume. The elongated recess 134 may provide the consumer with a visual indication of the amount of liquid that is to be applied and that the pump 160 (not shown) is working properly (e.g., the elongated recess 134 is sufficiently filled with liquid).

Figure 9B:
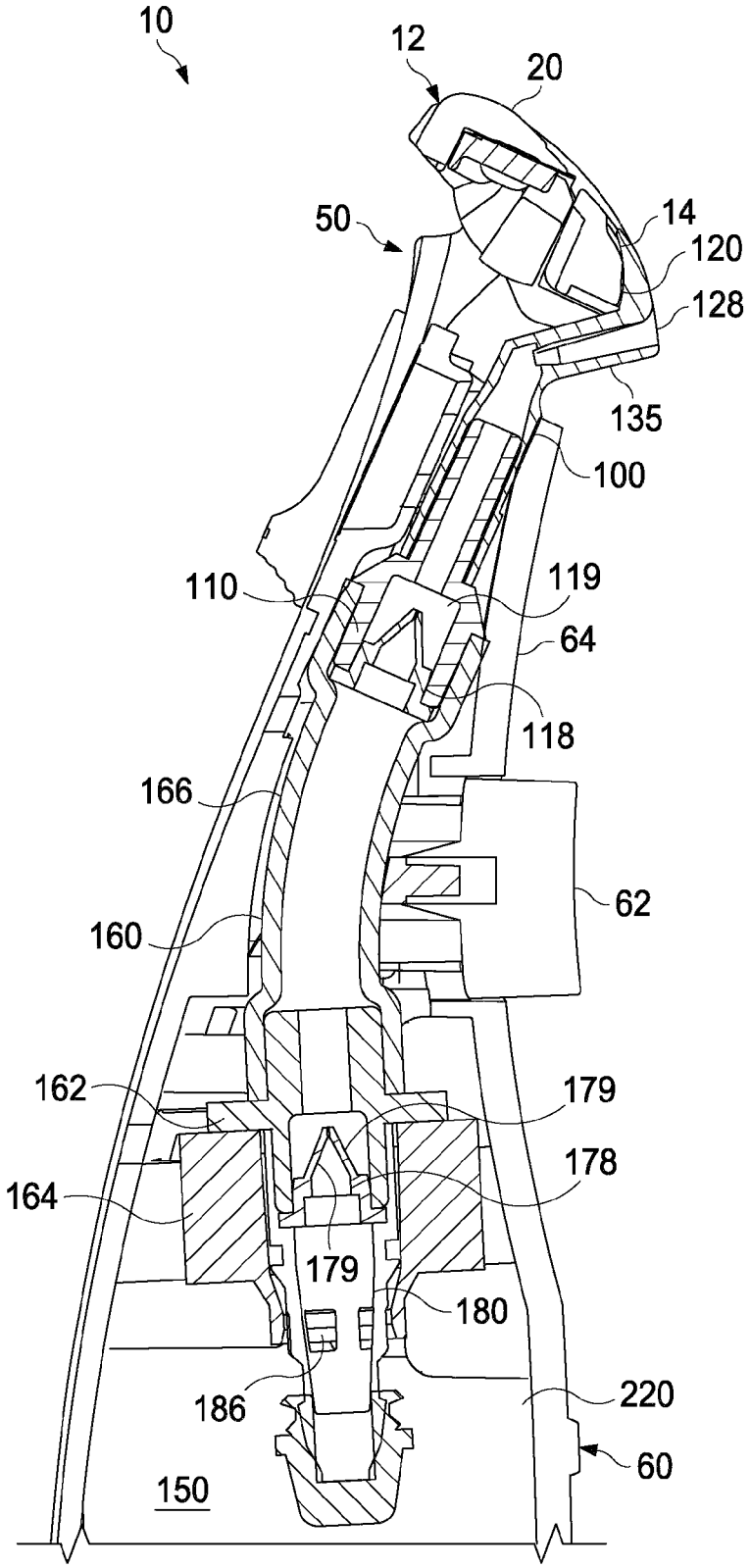
FIG. 9B is an enlarged partial cross section view of the shaving razor, taken generally along the line 9B-9B of FIG. 9A.

The applicator 100 may be molded from a thermoplastic elastomer such as TPE (thermoplastic elastomers). However, other resilient materials having a Shore A hardness (ISO 868) of about 50 to about 90 may be used including, but not limited to silicone, latex, polyvinylchloride (PVC), rubber, and polyurethanes. The applicator 100 may comprise a material having a tensile strength at break of about 8 $N/mm^2$, 9 $N/mm^2$, or 10 $N/mm^2$ to about 12 $N/mm^2$, 13 $N/mm^2$, or 14 $N/mm^2$ (ISO 37). The applicator 100 may comprise a material having a percent elongation at break of about 300% $mm^2$, 400%, or 500% to about 600% $mm^2$, 700%, or 800% (ISO 37). The hardness, tensile strength, and/or percent elongation of the applicator 100 may provide the front wall 132 of the baffle 130 with sufficient resiliency to flex and disperse the liquid. In certain embodiments, the front wall 132 may have a thickness of about 0.3 mm, 0.4 mm, or 0.5 mm to about 0.6 mm, 0.8 mm, or 1.0 mm such that the front wall 132 has sufficient resiliency for flexing and dispersing the liquid. The baffle 130 allows for the control and release of liquid during a shaving stroke. The elongated recess 134 allows the same volume of liquid to be dispersed with a single outlet port 128. Typically the same amount of volume would need to be dispersed by a plurality of smaller orifices (outlet ports). The smaller outlet ports may require a pump with more pressure and the outlet ports may become easily clogged with shaving debris. Smaller outlet ports also require lower viscosity liquids, which may limit the lotion or shaving prep that can be used with the hair removal device 10. In certain embodiments, the size of the outlet port 128 may be about 1 $mm^2$, 1.5 $mm^2$, or 2 $mm^2$ to about 4 $mm^2$, 6 $mm^2$, or 8 $mm^2$ Referring to FIG. 9B, an enlarged partial cross section view of the hair removal device 10, taken generally along the line 9B-9B of FIG. 9A is shown. The dispensing unit 150 may comprise flexible components, such as the applicator 100, the resilient tube 166, and the reservoir 220 to provide functionality while also being able to conform within size restraints of the handle 50. The resilient tube 166 may also be compressed anywhere along its outer surface (i.e., 360 degrees) to open the valve 118 while valve 178 remains closed to pump the liquid from the reservoir 220, thus allowing increase design flexibility for orienting the dispensing unit 150 within the handle 50. The applicator 100 may be removably mounted to the cartridge 12 (e.g., guard 120 of the applicator 100 may be positioned within the recess 14 of the housing 20, as shown in FIG. 9A). The applicator 100 may support and engage the cartridge 12 as the cartridge 12 pivots relative to the handle 50. As the cartridge 12 pivots, the applicator 100 may flex and apply a biasing force against the cartridge 12. The applicator 100 may bias the cartridge toward a neutral position. Accordingly, the applicator 100 may eliminate extra components by serving two functions, (1) distribute and disperse liquid and (2) bias the cartridge 12. The applicator 100 may have a base member 135 that defines the outlet port 128 and supports the cartridge 12. The base member 135 may extend transverse to the guard 120 of the applicator 100. The base member 135 may contact and support the cartridge 12. In certain embodiments, the applicator 100 (e.g., the base member 135 and the guard 120) may limit a pivot angle of the cartridge 12 relative to the handle 50. The cartridge 12 may pivot a total of 30 degrees to a total of about 45 degrees relative to the handle 50.

The resilient tube 166 may be directly or indirectly actuated at any point around its circumference (e.g., by direct contact by a consumers finger or the actuator 62). Once the dispensing unit 150 is activated, the applicator 100 may be in liquid communication with the pump 160 and the reservoir 220. The resilient tube 166 of the pump 160 allows the resilient tube 166 to be actuated along all 360 degrees of the resilient tube's surface. Accordingly, the resilient tube 166 allows the actuator 62 to be placed at any location of the hair removal device 10 (e.g., on the top, bottom, or the sides of the handle 50 and/or cover 60). The actuator 62 (e.g., a button) may be exposed on the outer surface 64 of the cover 60 and aligned with the pump 160 such that when the actuator 62 is depressed the resilient tube 166 is compressed to transport the liquid from the reservoir 220 to the applicator 100. The resilient tube 166 may be disposed between the first and second valves 118 and 178 (respectively). The resilient tube 166 may have a neutral position with both valves closed and a second position (i.e., when positive or negative pressure is applied) with one valve 118 or 178 open and one valve 118 or 178 closed. For example, in the second position, the resilient tube 166 may be compressed resulting in positive pressure being applied to the resilient tube 166 to open one of the valves 118 or 178. In the compressed position, liquid may travel from the resilient tube 166 through the first valve 118 positioned within the applicator connector 164, through the applicator 100 and out to the outlet port 128. The outlet port 128 may at least partially fill the elongated recess 134. For example, the volume of liquid of the resilient tube 166 may be about 0.1 ml to about 0.2 ml. It may be advantageous to avoid over filling of the elongated recess 134 which may result in liquid being dispensed onto the handle 50. In certain embodiments, the ratio of volume of the pump 160 (i.e., resilient tube 166) to the volume of the elongated recess 134 may be about 1:2 to about 1:5. Accordingly, the consumer may take several strokes with the hair removal device 10 before having to refill the elongated recess 134. Furthermore, it is inconvenient for the consumer to actuate the pump 160 too many times in order to fill the elongated recess 134. Also, if the volume of elongated recess 134 is too great or if only a single actuation of the pump fills the elongated recess 134, excessive liquid may be wasted.

In certain embodiments, the actuator 62 may directly contact the resilient tube 166 to compress the resilient tube 166 and open valve 118, while valve 178 remains closed. The valves 118 and 178 may each have a flattened end 119 and 179 (respectively) when closed. The flattened ends 119 and 179 may open to permit liquid to pass when under pressure is applied and a closed position to prevent liquid back flow when pressure is removed (e.g., when the actuator 62 is released from the resilient tube 166). The valve 178 may open (and the valve 118 may close) when negative pressure is achieved within the resilient tube 166 (e.g., when the actuator 62 is released and no longer compressing the resilient tube 166). The resilient properties (e.g., elongation at break and hardness) and the wall thickness of the resilient tube 166 may facilitate the resilient tube 166 returning to its natural state and achieve negative pressure within the resilient tube 166. When the valve 118 is closed and the valve 178 is open, liquid may travel from the reservoir 220, through the apertures 186 of the reservoir conduit 180, through the second valve 178 positioned within the pump connector 162 and into the resilient tube 166. The positioning of a resilient tube between a pair of one way valves positioned in series prevents back flow of shaving debris and microbes into the pump 160 and the reservoir 220. In certain embodiments, the resilient tube 166 may return the actuator 62 back to its original position. Accordingly, an additional return force member (e.g., a spring) is not necessarily required to return the actuator 62 back to its original position. The resilient tube 166 may be extruded or molded from materials having a Shore A hardness of about 40 to about 90 (ISO 868), including, but not limited to thermoplastic elastomers (TPEs), polyvinylchloride (PVC), silicones, rubbers, or any combination thereof. The resilient tube 166 may comprise a material having a tensile strength at break of about 8 MPa, 9 MPa, or 10 MPa to about 12 MPa, 13 MPa, or 14 MPa (ISO 37). The resilient tube 166 may comprise a material having a percent elongation at break of about 300% $mm^2$, 400%, or 500% to about 600% $mm^2$, 700%, or 800% (ISO 37). The resilient tube 166 may have a nominal wall thickness of about 0.5 mm, 0.75 mm, or 1 mm to about 1.25 mm, 1.5 mm, or 2 mm to provide sufficient flexibility to allow efficient compression of the resilient tube 166 by the actuator 62, but not too flexible such that the resilient tube 166 does not return to its original position after being repeatedly compressed.

Figure 10:
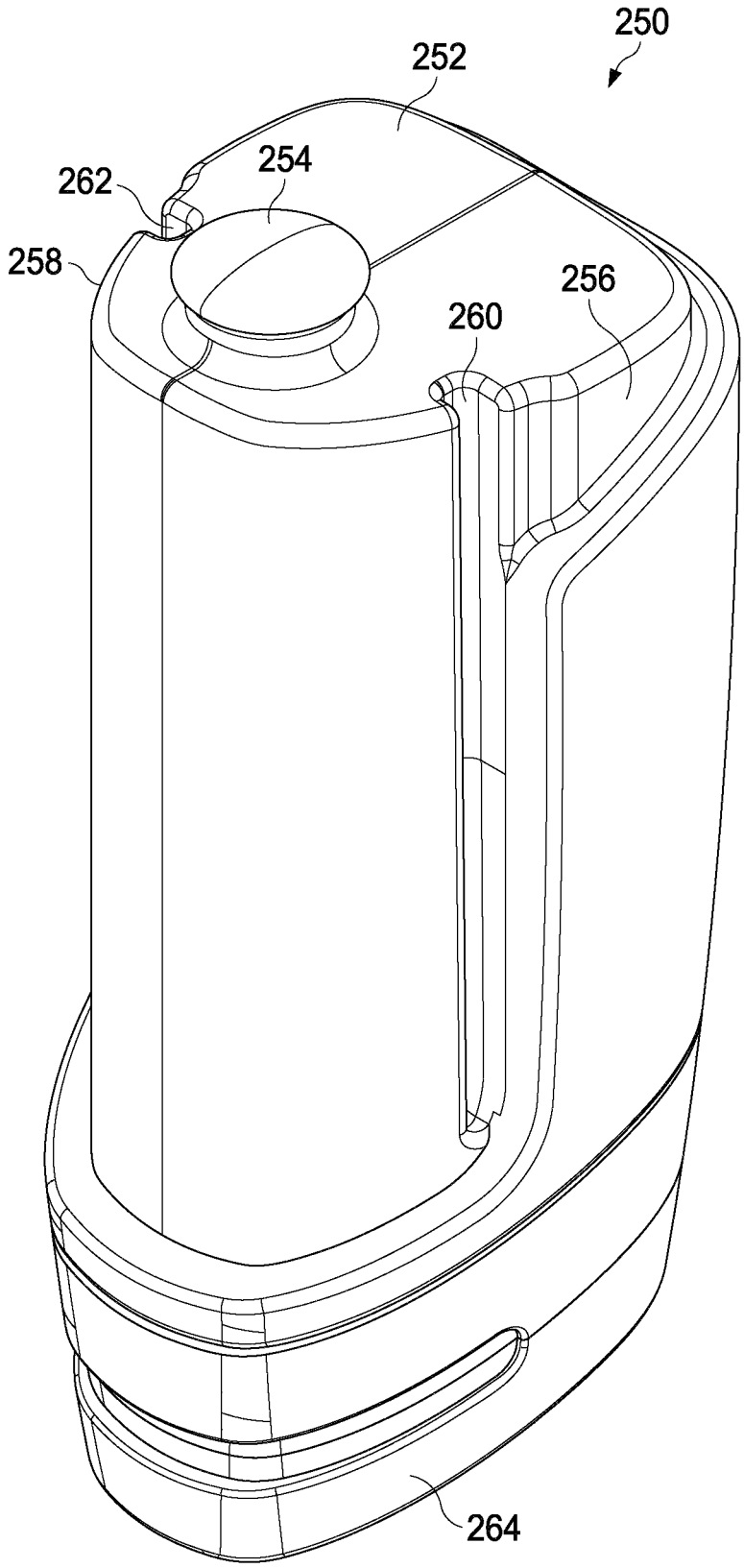
FIG. 10 is a perspective view of a personal care bottle which may be incorporated into the hair removal device of FIG. 1.

Referring to FIG. 10, a perspective view of the personal care bottle 250 is shown which may be incorporated into the hair removal device 10 of FIG. 1. The personal care bottle 250 may have a pair of opposing walls (e.g., top surface 280 and bottom surface 282) with different wall thicknesses. In certain embodiments, the personal care bottle 250 may be blow molded (e.g., injection blow molded) from polymeric materials including, but not limited to polyolefins (e.g., polyethylene and polypropylene), polyesters (e.g., PET), nylon, PVC, and TPEs. The personal care bottle 250 may have sufficient rigidity to securely mount to the handle 50, and sufficient flexibility to allow at least a portion of the personal care bottle 250 to be easily compressed (e.g., a material having a Shore D hardness of about 30 to about 80). The personal care bottle 250 may have a first end wall 252 with a connector 254 (e.g., a projection) for removeably securing the personal care bottle 250 to the handle 50 (not shown) of the hair removal device 10 (not shown). A first and second opposing side walls 256 and 258 may each have an alignment member 260 and 262 (e.g., an elongated groove or rail extending along the respective opposing side walls 256 and 258 transverse to the first end wall 252). The personal care bottle 250 may have a cap 264 opposite the first end wall 252.

The personal care bottle 250 may define a cavity 294 (not shown) containing a liquid. The liquid of the personal care bottle 250 may include one or more skin care compositions suitable for topical application. Non-limiting examples of suitable skin care compositions include aerosolized or non-aerosolized products such as: shaving gels, shaving foams, shaving lotions, shave oils, skin treatment compositions, cleansers, conditioning aids, depilatories, balms, lotions, moisturizers, etc. Examples of various types of aerosolized shaving preparations are available in U.S. Pat. Nos. 5,560,859; 5,587,156; 5,326,556; and 5,500,211; and U.S. patent Publ. No. 2007/0207106. Non-aerosol shave preparations typically include either emulsions (creams/lotions) or gels, which most commonly consist of polymer thickened surfactant systems. See e.g. U.S. Pat. Nos. 5,902,574 and 5,262,154; and U.S. patent Publ. No. 2007/0207106. Further, the skin care composition can be a foaming or non-foaming product. Non-limiting examples of non-foaming products are available in: WO9318740; and U.S. Pat. Nos. 4,585,650, and 3,072,536.

In one embodiment, the liquid contained in the personal skin care bottle 250 and the liquid contained in the reservoir 220 (not shown) are not the same. For example, in one embodiment, the liquid contained in the reservoir 220 may comprise a skin or hair liquid composition which is applied to the skin prior to the liquid contained in the personal care bottle 250. The liquid contained in the reservoir 220 may prepare and/or aid in the removal of hair, such as one or more of the foaming or non-foaming shave preparations mentioned above (gels, foams, lotions, oils, cleansers, depilatories, numbing agents, etc). In this same embodiment, the liquid contained in the personal care bottle 250 may comprise a skin treatment composition which can be a moisturizer, lotion, balm, cooling agent, or other skin conditioning aid. Additionally, one or more of the liquids contained in either the reservoir 220 or the personal care bottle 250 may comprise benefit agents suitable for skin and/or hair that may be useful for a number of different desirable effects including exfoliation, cooling effects, cleansing, moisturizing, warming or thermogenic effects, conditioning, and the like. Suitable benefit agents for skin and/or hair for inclusion into the liquid of the razor are disclosed in U.S. Pat. No. 6,789,321 and U.S. Pat. Publ. 2008/0069784. For instance, suitable agents include but are not limited to shaving soaps, lubricants, skin conditioners, skin moisturizers, hair softeners, hair conditioners, fragrances, skin cleansers, bacterial or medical lotions, blood coagulants, anti-inflammatories, astringents, sun screens, fragrances, and combinations thereof.

Figure 11:
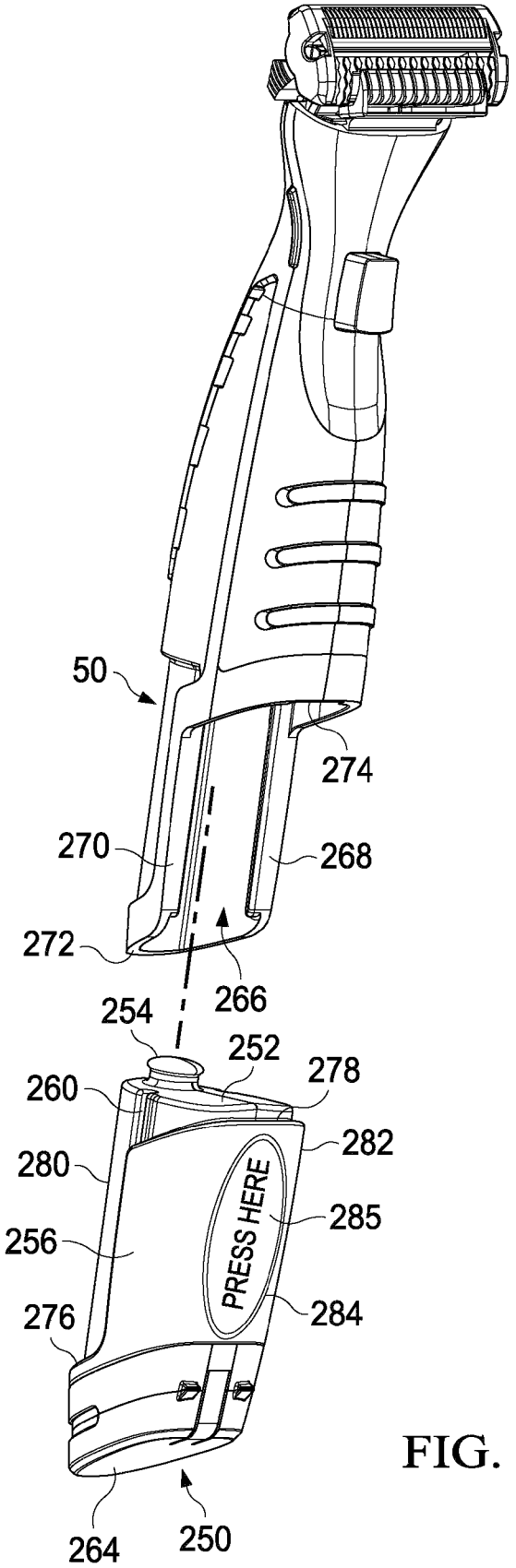
FIG. 11 is a perspective assembly view of the hair removal device of FIG. 1.

Referring to FIG. 11, a perspective assembly view of the personal care bottle 250 and handle 50 is shown. The personal care bottle 250 may slidingly engage the handle 50. The handle 50 may define an opening 266 dimensioned to receive a portion of the personal care bottle 250. The first end wall 252 and the connector 254 may be disposed within the opening 266. The opening 266 of the handle 50 may receive about 50%, 60%, or 70% to about 80%, 90%, or 100% of the top surface 280 of the personal care bottle 250. The opening 266 of the handle 50 may also receive about 25%, 30%, or 35% to about 55%, 65%, or 75% of the first and second opposing side walls 256 and 258 of the personal care bottle 250. The bottom surface 282 may be spaced apart from the handle 50 such that a consumer may squeeze the bottom surface 282 when the personal care bottle 250 is mounted to the handle 50. The positioning of the top surface 280 and the first and second opposing side walls 256 and 258 within the opening 266 reduces the probability that the consumer may unintentionally release liquid by squeezing the personal care bottle 250. In addition, the exposed bottom surface 282 may intuitively provide an area for the consumer to squeeze the personal care bottle 250 to release liquid. The handle 50 may have a pair of alignment members 268 and 270 (e.g., an elongated groove or rail) that engage the corresponding alignment members 260 and 262 of the personal care bottle 250. The alignment members 268 and 270 of the handle 50 and the alignment members 260 and 262 of the personal care bottle may facilitate the secure attachment of the personal care bottle 250 to the handle 50. The handle 50 may engage the personal care bottle 250 at three different locations (e.g., the first and second opposing side walls 256 and 258 and the first end wall 252) for strongly securing of the personal care bottle 250. The personal care bottle 250 may unintentionally disengage the handle 50 or become damaged during use. Additional forces may be applied to the personal care bottle 250 during use because the personal care bottle 250 is exposed at an end of the handle 50. Accordingly, the personal care bottle 250 may be secured on three different sides (e.g., by the alignment members 260 and 262 and the connector 254).

The handle 50 may have a pair of offset stop surfaces 272 and 274 that contact a corresponding pair of shoulders 276 and 278 on the personal care bottle 250. The shoulder 276 (e.g., first shoulder) may be located on the top surface 280 of the personal care bottle 250 toward cap 264. The shoulder 278 (e.g., second shoulder) may be laterally offset from the shoulder 276 (i.e., toward the first end wall 252) and located on the opposing bottom surface 282. The pair of offset shoulders 276 and 278 may allow the bottom surface 282 to be exposed (e.g., spaced apart from the handle 50) when the personal care bottle 250 is secured to the handle 50. For example, the shoulder 278 may contact surface 274 of the handle to prevent the bottom surface 282 from being received within the opening 266 of the handle 50. Furthermore, the pair of offset shoulders 276 and 278 allow the top surface 280 to be covered (e.g., protected) by the handle 50. Accordingly, the top surface 280 may be positioned within the opening 266 of the handle while the bottom surface 282 is not positioned within the opening 266 (i.e., exposed) after the personal care bottle 250 is secured to the handle 50. Damage and disengagement of the personal care bottle may also be reduced because the personal care bottle 250 is supported by the handle 50 on several sides (e.g., the top surface 280, the first end wall 252, and at least a portion of the first and second opposing side walls 256 and 258 (see FIG. 10) may be positioned within the opening 266 of the handle 50). In certain embodiments, at least a portion of the first and second opposing side walls 256 and 258 may be positioned within the opening 266 of the handle 50. For example, about 20%, 25%, or 30% to about 60%, 70%, or 80% of the first and second opposing side walls 256 and 258 may be positioned within the opening 266.

The bottom surface 282 may have a wall thickness that is less than a wall thickness of the top surface 280. In certain embodiments, the wall thickness of the bottom surface 282 may be about 30%, 40%, or 50% to about 70%, 80%, or 90% less than the wall thickness of the top surface 280. For example, the wall thickness of the bottom surface 282 may be about 1.2 mm and the wall thickness of the top surface 280 may be about 3.8 mm (about 68% reduction in wall thickness). The reduced wall thickness of the bottom surface 282 allows the consumer to easily compress the bottom surface 282 to release the liquid from the personal care bottle 250. For example, a polyethylene bottle having a 68% reduction in wall thickness (with the same dimensions given above) may result in a 70% reduction in force required to compress the bottom surface 282 a distance of 2 mm compared to the top surface 280. In certain embodiments, the force required to compress the bottom surface 282 may be about 30%, 40%, or 50% to about 70%, 80%, or 90% less than the force required to compress the top surface 280 the same distance. The bottom surface 282 may also include one or more indicia 284 (e.g., one or more grooves extending around a circumference, such as an oval). The indicia 284 may indicate an area of reduced wall thickness 285 (e.g., located within the indicia) signaling to the consumer where to press on the personal care bottle 250 to release the liquid. The indicia may also include wording or symbols, such as "press here".

Figure 12:
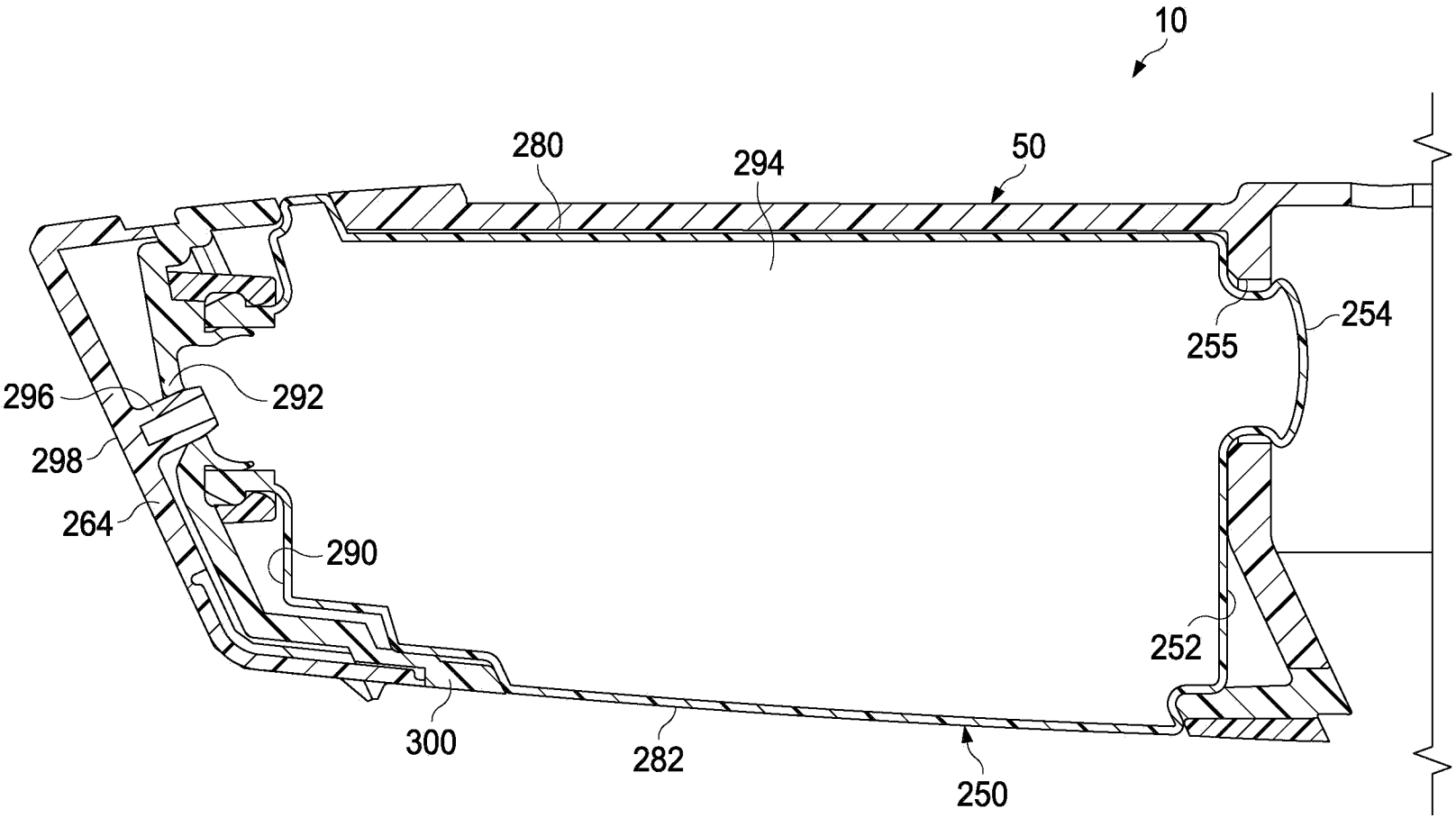
FIG. 12 is an enlarged partial cross section view of the hair removal device, taken generally along the line 12-12 of FIG. 1B.

Referring to FIG. 12, an enlarged partial cross section view of the hair removal device 10, taken generally along the line 12-12 of FIG. 1B is illustrated. A second end wall 290 opposing the first end wall 252 may connect the top and bottom surfaces 280 and 282. The second end wall 290 may define an aperture 292 in liquid communication with the cavity 294. A cap 264 may be mounted to the second end wall 290 to prevent the flow of liquid out of the aperture 292. In certain embodiments, the aperture 292 may be positioned along the second end wall 290 toward the top surface 280. The cap 264 may have a back wall 298 not parallel (i.e., at an obtuse angle) to the first end wall 252. In certain embodiments, the back wall 298 of the cap may have an angle of about 15 degrees, 20 degrees, or 25 degrees to about 30 degrees, 35 degrees, or 40 degrees relative to the first end wall 252. The cap 264 may have a plug 296 projecting from the back wall 298 and positioned within the opening 292 of the second wall 290. In certain embodiments, a hinge 300 may interconnect the cap 264 to the personal care bottle 250 (e.g., the bottom surface 282). The handle 50 may define an internal opening 255. The connector 254 may be disposed within the opening to secure the personal care bottle 250 to the handle 50. In certain embodiments, the opening 255 may be in communication with the cavity 70 of the handle 50.

Figure 13:
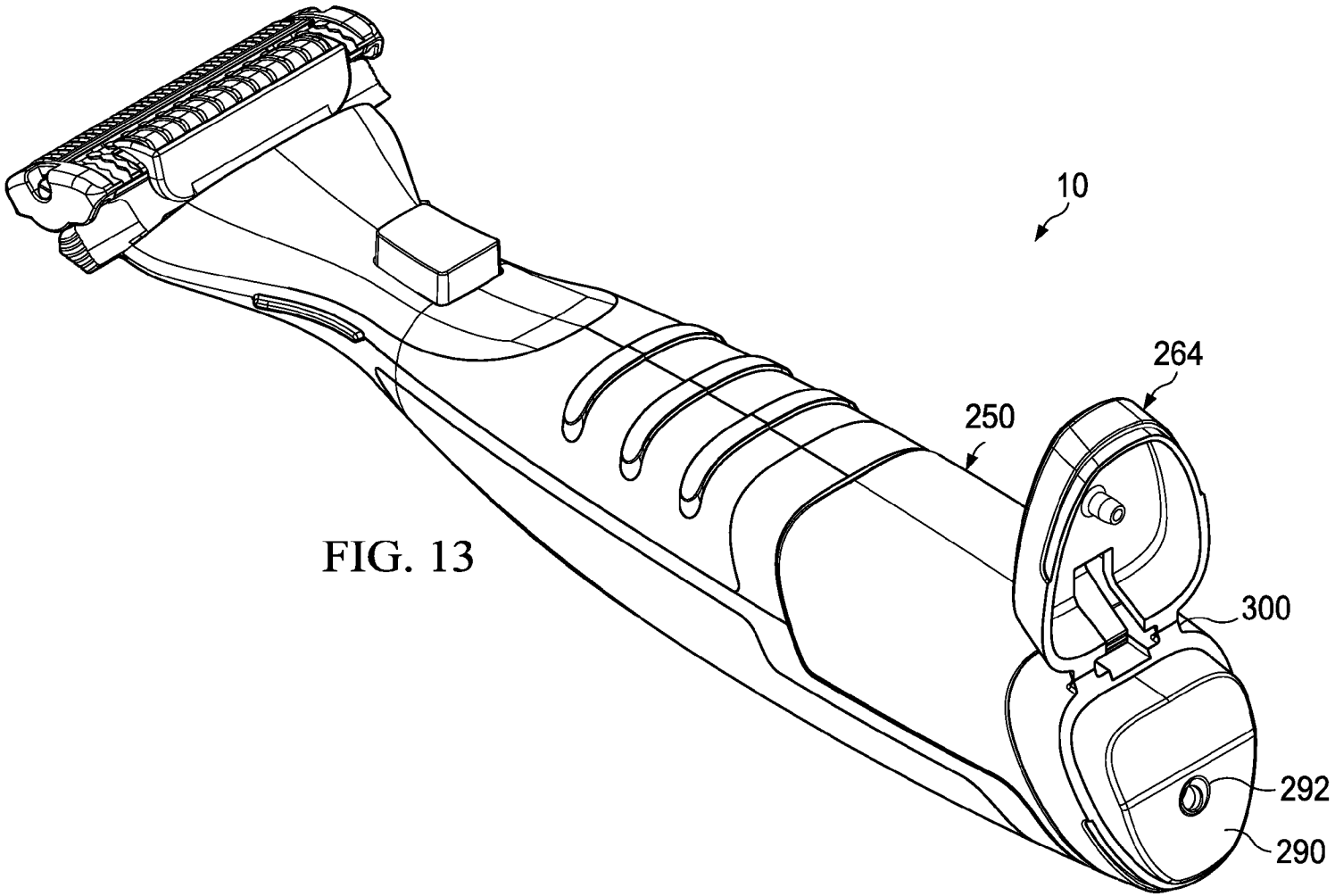
FIG. 13 is a perspective view of the hair removal device of FIG. 1 with the cap in an open position.

Referring to FIG. 13, a perspective view of the hair removal device 10 is shown with the cap 264 in a fully open position. In certain embodiments, the cap 264 may be attached to the personal care bottle 250 with the hinge 300. The hinge 300 may be offset from the aperture 292 defined by the end wall 290 (i.e., spaced apart from the end wall 290) of the personal care bottle 250. In certain embodiments, the hinge 300 may be spaced apart from the end wall 290 by about 5 mm, 10 mm, or 15 mm to about 20 mm, 25 mm, or 30 mm. The cap 264 and/or hinge 300 may be disposed at an angle (i.e., not parallel) relative to the second end wall 290 that defines the aperture 292. In certain embodiments, the cap 264 and/or hinge 300 may be disposed at an angle of about 15 degrees, 20 degrees, or 25 degrees to about 30 degrees, 35 degrees, or 40 degrees relative to the second end wall 290. The angle and/or offset of the hinge 300 and/or cap 264 may allow for greater access to the aperture 292 (i.e., cap 264 opens more than 180 degrees relative to the second end wall 290).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" Furthermore, dimensions should not be held to an impossibly high standard of metaphysical identity that does not allow for discrepancies due to typical manufacturing tolerances. Therefore, the term "about" should be interpreted as being within typical manufacturing tolerances.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid dispensing hair removal device comprising:
a handle;
a cartridge mounted to the handle, the cartridge having a cartridge guard, a cap, and at least one blade behind the cartridge guard and in front of the cap, wherein the cartridge guard has a plurality of projections extending transverse to the blade and wherein the cartridge guard defines an elongated recess; and
a dispensing unit within the handle, the dispensing unit comprising
a reservoir,
a pump in liquid communication with the reservoir, and
an applicator in liquid communication with the pump, wherein the applicator has an applicator guard with a plurality of ribs and an outlet port in front of the ribs, wherein the applicator guard is positioned within the elongated recess of the cartridge guard and wherein the plurality of ribs of the applicator guard are aligned with the plurality of projections of the cartridge guard.

2. The liquid dispensing hair removal device of claim 1 wherein the plurality of ribs define a plurality of open channels that are transverse to the blade.

3. The liquid dispensing hair removal device of claim 1 wherein the applicator has at least one alignment member that engages an alignment member on the handle.

4. The liquid dispensing hair removal device of claim 1 wherein the applicator has a pair of spaced apart alignment members with a different size, shape, or orientation.

5. The liquid dispensing hair removal device of claims 3 or 4 wherein at least one of the alignment members is a recess.

6. The liquid dispensing hair removal device of claims 3 or 4 wherein at least one of the alignment members is a projection.

7. The liquid dispensing hair removal device of claim 1, 2, 3, or 4 wherein the applicator has a Shore A hardness of 50 to 90.

* * * * *